US009595231B2

(12) United States Patent
Umezaki

(10) Patent No.: US 9,595,231 B2
(45) Date of Patent: Mar. 14, 2017

(54) METHOD FOR DRIVING DISPLAY DEVICE

(75) Inventor: Atsushi Umezaki, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 217 days.

(21) Appl. No.: 13/090,360

(22) Filed: Apr. 20, 2011

(65) Prior Publication Data

US 2011/0261042 A1 Oct. 27, 2011

(30) Foreign Application Priority Data

Apr. 23, 2010 (JP) ..... 2010-099844

(51) Int. Cl.
*G09G 5/00* (2006.01)
*G09G 3/34* (2006.01)

(52) U.S. Cl.
CPC ..... *G09G 3/344* (2013.01); *G09G 2300/08* (2013.01); *G09G 2300/0857* (2013.01); *G09G 2310/0251* (2013.01); *G09G 2310/0254* (2013.01); *G09G 2320/0257* (2013.01); *G09G 2330/021* (2013.01)

(58) Field of Classification Search
CPC .... G09G 3/344; G09G 3/3453; G09G 3/3433; G09G 2300/0482; G09G 2300/0486; G09G 2300/0491; G09G 2300/0495; G09G 2310/068; G02F 1/167
USPC ..... 345/107, 84–106
See application file for complete search history.

(56) References Cited

U.S. PATENT DOCUMENTS 4,345,249 A 8/1982 Togashi
4,393,380 A 7/1983 Hosokawa et al.
5,296,847 A 3/1994 Takeda et al.
5,448,384 A 9/1995 Uchino et al.
5,537,129 A 7/1996 Okada et al.
5,793,346 A 8/1998 Moon
5,847,687 A 12/1998 Hirakata et al.
5,867,139 A 2/1999 Tanaka et al.
5,903,249 A 5/1999 Koyama et al.
5,926,161 A 7/1999 Furuhashi et al.
5,926,162 A 7/1999 Wood et al.
5,945,970 A 8/1999 Moon et al.
(Continued)

FOREIGN PATENT DOCUMENTS

EP 2 136 354 A2 12/2009
JP 2006-267982 10/2006
(Continued)

OTHER PUBLICATIONS

Taiwanese Office Action re Application No. TW 100112969, dated Sep. 17, 2015.

*Primary Examiner* — Jason Olson
*Assistant Examiner* — Sardis F Azongha
(74) *Attorney, Agent, or Firm* — Husch Blackwell LLP

(57) ABSTRACT

Objects are to provide a display device in which images with higher quality are displayed by a reduction in afterimages of a previously displayed image, and to reduce power consumption of the display device. A pixel in the display device is initialized to suppress an afterimage due to the previous gray level of a display element. Specifically, a voltage applied to the display element for initialization and the time for applying the voltage are changed in accordance with the previous gray level of the display element. Initialization of the display element can prevent an afterimage of a previously displayed image.

8 Claims, 23 Drawing Sheets

(56) References Cited

U.S. PATENT DOCUMENTS

| | | | | |
|---|---|---|---|---|
| 6,005,542 | A | 12/1999 | Yoon | |
| 6,031,514 | A | 2/2000 | Hashimoto et al. | |
| 6,911,962 | B1 | 6/2005 | Hirakata et al. | |
| 6,987,503 | B2 | 1/2006 | Inoue | |
| 7,336,249 | B2 | 2/2008 | Hirakata et al. | |
| 7,701,435 | B2 * | 4/2010 | Hiramatsu | 345/107 |
| 7,773,069 | B2 | 8/2010 | Miyasaka et al. | |
| 8,102,363 | B2 * | 1/2012 | Hirayama | G09G 3/344 345/105 |
| 8,264,454 | B2 * | 9/2012 | Kim et al. | 345/107 |
| 8,300,006 | B2 | 10/2012 | Zhou et al. | |
| 8,334,836 | B2 * | 12/2012 | Kanamori | G02F 1/167 345/107 |
| 8,928,575 | B2 * | 1/2015 | Moriya | G09G 3/344 345/107 |
| 9,142,179 | B2 | 9/2015 | Kimura et al. | |
| 2002/0005832 | A1 * | 1/2002 | Katase | 345/107 |
| 2006/0279501 | A1 * | 12/2006 | Lu | G09G 3/3651 345/94 |
| 2007/0002008 | A1 * | 1/2007 | Tam | 345/107 |
| 2007/0182704 | A1 | 8/2007 | Hiramatsu | |
| 2008/0007816 | A1 * | 1/2008 | Maeda | G09G 3/344 359/296 |
| 2008/0143668 | A1 * | 6/2008 | Shin et al. | 345/107 |
| 2008/0238865 | A1 * | 10/2008 | Maeda | G09G 3/344 345/107 |
| 2008/0278472 | A1 | 11/2008 | Huitema et al. | |
| 2008/0284933 | A1 | 11/2008 | Ito et al. | |
| 2010/0079428 | A1 * | 4/2010 | Kajino | 345/208 |
| 2010/0265245 | A1 * | 10/2010 | Miyasaka et al. | 345/107 |

FOREIGN PATENT DOCUMENTS

| | | | |
|---|---|---|---|
| JP | 2007-206471 | A | 8/2007 |
| JP | 2008-139738 | A | 6/2008 |
| TW | 200523826 | | 7/2005 |
| TW | 200609897 | | 3/2006 |
| TW | 200828236 | | 7/2008 |
| TW | 200951593 | | 12/2009 |
| WO | WO 2005/034074 | A1 | 4/2005 |
| WO | WO 2005/093704 | A1 | 10/2005 |

* cited by examiner

METHOD FOR DRIVING DISPLAY DEVICE

BACKGROUND OF THE INVENTION

1. Field of the Invention

The present invention relates to a semiconductor device, a display device, and a method for driving these devices. In particular, the present invention relates to a display device including a display element with memory properties, and a method for driving the display device.

2. Description of the Related Art

In recent years, display devices such as e-book readers have been actively developed. In particular, a technique by which images are displayed using a display element with memory properties has been actively developed since it greatly contributes to the reduction in power consumption (Patent Document 1).

REFERENCE

Patent Document 1: Japanese Published Patent Application No. 2006-267982

SUMMARY OF THE INVENTION

In a conventional display device, all the pixels are reset at the same time; thus, an afterimage of an image previously displayed is left. Moreover, only voltages of one polarity are applied to a display element in order to express gray levels, so that it is difficult to control the gray level minutely.

In view of the above problems, an object of one embodiment of the present invention is to display images with higher quality by a reduction in afterimages in a display device. Another object of one embodiment of the present invention is to reduce power consumption of a display device.

A pixel is initialized to suppress an afterimage due to the previous gray level of a display element. Specifically, a voltage applied to the display element for initialization and the time for applying the voltage are changed in accordance with the previous gray level of the display element.

One embodiment of the invention disclosed in this specification is a method for driving a display device including a first electrode, a second electrode, and a display element placed between the first electrode and the second electrode. The driving method has a first period and a second period. In the first period, a first potential is applied to the first electrode, and a third potential is applied to the second electrode. In the second period, a second potential is applied to the first electrode after the first potential is applied, and a fourth potential is applied to the second electrode after the third potential is applied.

The driving method may have a third period provided before the first period. In the third period, the first potential and the second potential are selectively applied to the first electrode, and the third potential is applied to the second electrode.

The driving method may have a fourth period provided after the second period. In the fourth period, the first potential and the second potential are selectively applied to the first electrode, and the fourth potential is applied to the second electrode.

In any of the above driving methods, the first potential may be equal to the third potential. The second potential may be equal to the fourth potential. The second period may be longer than the first period.

One embodiment of the invention disclosed in this specification is a method for driving a display device including a first electrode, a second electrode, a display element placed between the first electrode and the second electrode, and a switching element connected between the first electrode and a wiring. The driving method has a first period and a second period. In the first period, the switching elements in the plurality of pixels are sequentially turned on, a first potential is applied to the wiring, and a third potential is applied to the second electrode. In the second period, the switching elements in the plurality of pixels are concurrently turned on, a second potential is applied to the wiring after the first potential is applied, and a fourth potential is applied to the second electrode after the third potential is applied.

The driving method may have a third period provided before the first period. In the third period, the switching elements in the plurality of pixels are sequentially turned on, the first potential and the second potential are selectively applied to the wiring, and the third potential is applied to the second electrode.

The driving method may have a fourth period provided after the second period. In the fourth period, the switching elements in the plurality of pixels are sequentially turned on, the first potential and the second potential are selectively applied to the wiring, and the fourth potential is applied to the second electrode.

In any of the above driving methods, the first potential may be equal to the third potential. The second potential may be equal to the fourth potential. The second period may be longer than the first period.

According to one embodiment of the present invention, images with higher quality can be displayed in the display device. Moreover, according to one embodiment of the present invention, power consumption of the display device can be reduced.

DETAILED DESCRIPTION OF THE INVENTION

Figure 1B:
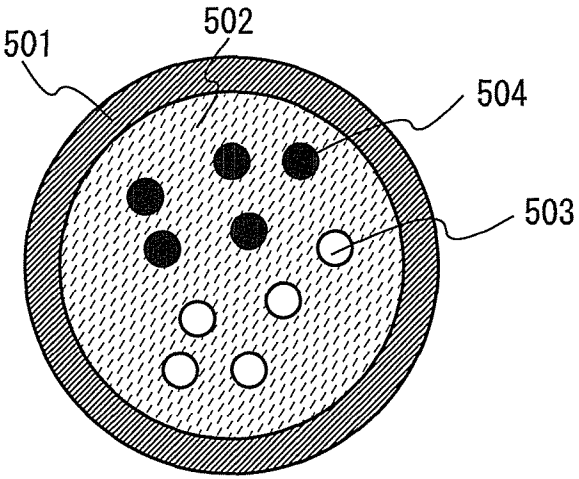
FIG. 1B is an example of a cross-sectional view of a microcapsule electrophoretic element in Embodiment 1.

Embodiments will be hereinafter described with reference to the accompanying drawings. Note that the embodiments can be implemented with various modes, and it will be readily appreciated by those skilled in the art that modes and details can be changed in various ways without departing from the spirit and scope of the present invention. Therefore, the present invention should not be construed as being limited to the following description of the embodiments. Note that in structures described below, the same portions or portions having similar functions are denoted by common reference numerals in different drawings, and description thereof is not repeated.

(Embodiment 1)

In this embodiment, an example of a display device and an example of a method for driving the display device will be described. Specifically, an example of a pixel included in a display device and an example of a method for driving the pixel will be described. More specifically, an example of a pixel including a display element with memory properties and an example of a method for driving the pixel will be described.

First, an example of a pixel in this embodiment will be described.

Figure 1A:
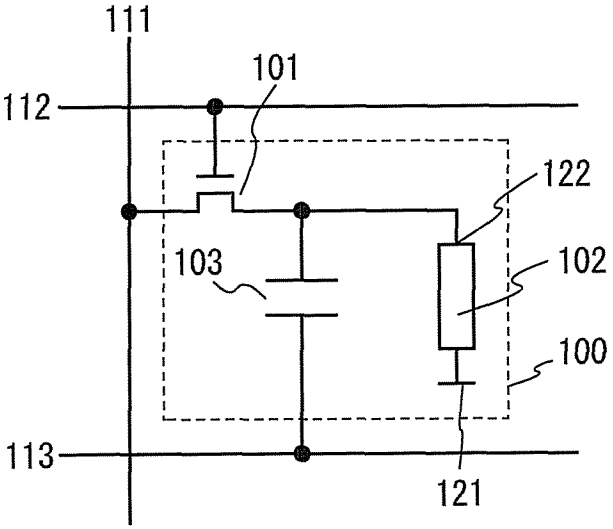
FIG. 1A is an example of a circuit diagram of a pixel in Embodiment 1.

FIG. 1A illustrates an example of a pixel in this embodiment. A pixel 100 includes a transistor 101, a display element 102, and a capacitor 103. A first terminal (one of a source and a drain) of the transistor 101 is connected to a wiring 111. A second terminal (the other of the source and the drain) of the transistor 101 is connected to one electrode of the display element 102 and one electrode of the capacitor 103. A gate of the transistor 101 is connected to a wiring 112. The other electrode of the display element 102 is connected to an electrode 121 (also referred to as a common electrode, a cathode electrode, a counter electrode, or a cathode). The other electrode of the capacitor 103 is connected to a wiring 113.

Note that one electrode of the display element 102 is referred to as an electrode 122 (also referred to as a pixel electrode).

The transistor 101 is an n-channel transistor. An n-channel transistor is turned on when a potential difference between the gate and the source exceeds the threshold voltage. However, one example of this embodiment is not limited to this. For example, the transistor 101 can be a p-channel transistor. A p-channel transistor is turned on when a potential difference between the gate and the source gets lower than the threshold voltage.

As the display element 102, a display element with memory properties is used. A display element with memory properties refers to an element that can hold display data for a given period of time with zero voltage applied. In this embodiment, the case where an element illustrated in FIG. 1B is used as the display element 102 will be described. FIG. 1B illustrates an example of a microcapsule electrophoretic element. The microcapsule electrophoretic element includes a film 501, a fluid 502, particles 503, and particles 504. The fluid 502, the particles 503, and the particles 504 are sealed in the film 501.

Note that the fluid 502, the particles 503, and the particles 504 may be sealed in a small space formed between a pair of substrates (i.e., a microcup structure). With such a structure, the endurance can be improved.

Note that a display device including an element utilizing electrophoresis is sometimes called an electrophoretic display device.

The film 501 is formed using a light-transmitting material (e.g., a polymer resin such as an acrylic resin (e.g., poly (methyl methacrylate) or poly(ethyl methacrylate)), a urea resin, or gum arabic), for example. The film 501 of the microcapsule electrophoretic element is preferably gelatinous. When the film 501 is gelatinous, the plasticity, bending strength, mechanical strength, and the like can be improved, leading to improvement in flexibility. Alternatively, microcapsule electrophoretic elements can be evenly arranged over a substrate such as a film.

The fluid 502 has a function of dispersing the particles 503 and the particles 504, that is, a function of a dispersion medium. As the fluid 502, a light-transmitting oil-based liquid is preferably used, for example. Specific examples of the fluid 502 are an alcohol-based solvent (e.g., methanol and ethanol), ester (e.g., ethyl acetate and butyl acetate), aliphatic hydrocarbon (e.g., ketone such as acetone and methyl ethyl ketone, pentane, hexane, and octane), alicyclic hydrocarbon (e.g., cyclohexane and methylcyclohexane), aromatic hydrocarbon such as benzene having a long-chain alkyl group (e.g., benzene, toluene, and xylene), halogenated hydrocarbon (e.g., methylene chloride, chloroform, carbon tetrachloride, and dichloroethane), calboxylate salt, water, and other kinds of oils. Other examples of the fluid 502 are a mixture of two or more of the above-described materials, a combination of a surface active agent or the like and one of the above materials, and a combination of a surface active agent or the like and a mixture of two or more of the above materials.

Note that the fluid 502 can be colored. A display element including a colored fluid 502 can realize a display device capable of performing color display.

The particles 503 and 504 are formed using pigments. The pigment used for the particles 503 and the pigment used for the particles 504 have different colors. For example, the particles 503 are formed using a white pigment and the particles 504 are formed using a black pigment. Examples of the white pigment are titanium dioxide, zinc white (zinc oxide), and antimony trioxide. Examples of the black pigment are aniline black and carbon black. Note that it is possible to add, to the above-described pigment, a charge controlling agent (e.g., electrolyte, a surface active agent, metallic soap, resin, rubber, oil, varnish, or a compound), a dispersing agent (e.g., a titanium-based coupling agent or a silane-based coupling agent), a lubricant agent, a stabilizing agent, or the like.

The particles 503 and 504 are charged. For example, the particles 503 are charged either positively or negatively, and the particles 504 are charged oppositely to the particles 503.

Note that the particles 503 and 504 can be formed using pigments of various colors other than a white pigment and a black pigment. For example, the particles 503 and 504 can be formed using a red pigment, a green pigment, a blue pigment, or the like.

As the display element 102, a variety of elements other than a microcapsule electrophoretic element can be used. Examples of an element used as the display element 102 and a method for driving the element are a horizontal electrophoretic element, a vertical electrophoretic element, twisting ball, liquid powder display, electronic liquid powder, a cholesteric liquid crystal element, chiral nematic liquid crystal, anti-ferroelectric liquid crystal, polymer dispersed liquid crystal, charged toner, electrowetting, electrochromism, and electrodeposition.

A signal is input to the wiring 111. An example of the signal input to the wiring 111 is a signal for controlling a state of the display element 102 (e.g., the gray level or the position of charged particles) (i.e., a video signal); accordingly, the wiring 111 functions as a signal line or a source signal line (also referred to as a video signal line or a source line).

Note that the signal input to the wiring 111 has two potentials of an H-level potential and an L-level potential. The H-level potential of the signal input to the wiring 111 is referred to as VH and the L-level potential thereof is referred to as VL. That is, the potential VH and the potential VL are selectively applied to the wiring 111. Thus, a digital signal can be input to the wiring 111, and a circuit that outputs a signal to the wiring 111 can be a digital circuit. However, this embodiment is not limited to this example. For example, a predetermined voltage can be supplied to the wiring 111. Alternatively, three or more potentials can be selectively applied to the wiring 111. Further alternatively, the wiring 111 can be placed in a high impedance state. That is, supply of a signal, voltage, and the like to the wiring 111 can be stopped and the wiring 111 can be placed in a floating state. Consequently, power consumption can be reduced.

A signal is input to the wiring 112. An example of the signal input to the wiring 112 is a signal for controlling a conduction state of the transistor 101 (also referred to as a gate signal, a selection signal, or a scan signal); accordingly, the wiring 112 functions as a signal line or a gate signal line (also referred to as a gate line or a scan line).

Note that the signal input to the wiring 112 has two potentials of an H-level potential and an L-level potential. The H-level potential of the signal input to the wiring 112 is equal to or higher than the potential VH, and the L-level potential thereof is equal to or lower than the potential VL. That is, the potential equal to or higher than the potential VH and the potential equal to or lower than the potential VL are selectively applied to the wiring 112. However, this embodiment is not limited to this example. For example, a predetermined voltage can be supplied to the wiring 112. Alternatively, the wiring 112 can be placed in a high impedance state. That is, supply of a signal, voltage, and the like to the wiring 112 can be stopped and the wiring 112 can be placed in a floating state. Consequently, power consumption can be reduced.

A predetermined voltage is supplied to the wiring 113; accordingly, the wiring 113 has a function of a power supply line. Specifically, the wiring 113 has a function of a capacitor line because it is connected to the capacitor 103. However, this embodiment is not limited to this example. For example, the potential of the electrode 122 can be controlled by changing the voltage input to the wiring 113. Thus, the amplitude voltage of the signal input to the wiring 111 can be reduced, resulting in a reduction in power consumption.

A voltage (also referred to as a common voltage) is supplied to the electrode 121. The voltage supplied to the electrode 121 has two values of VH and VL. That is, the potential VH and the potential VL are selectively applied to the electrode 121. Thus, the amplitude voltage of the signal input to the wiring 111 can be reduced. Moreover, the kinds of signals input to the wiring 111 can be reduced. In addition, since the voltage applied to the electrode 121 has the same two values as the signal input to the wiring 111, the kinds of voltages can be reduced in the entire display device. However, this embodiment is not limited to this example. For example, a predetermined voltage can be supplied to the electrode 121. In the case where a predetermined voltage is supplied to the electrode 121, it is preferable that a potential higher than the potential of the electrode 121, a potential equal to the potential of the electrode 121, and a potential lower than the potential of the electrode 121 be selectively supplied to the wiring 111. As another example, to the electrode 121, a potential higher or lower than the potential VH can be applied instead of the potential VH, and a potential higher or lower than the potential VL can be applied instead of the potential VL. Alternatively, the electrode 121 can be placed in a high impedance state. That is, supply of a signal, voltage, and the like to the electrode 121 can be stopped and the electrode 121 can be placed in a floating state. Consequently, power consumption can be reduced.

Note that "inversion of the potential of the electrode 121" refers to a change of the potential of the electrode 121 from VL to VH and a change of the potential of the electrode 121 from VH to VL. Inversion of the potential of the electrode 121 is referred to as common inversion.

Next, an example of operation of the pixel in this embodiment will be described. Specifically, an example of operation when the potential VL (also referred to as a first potential) is applied to the electrode 121 and then the potential VH (also referred to as a second potential) is applied will be described.

Figure 2:
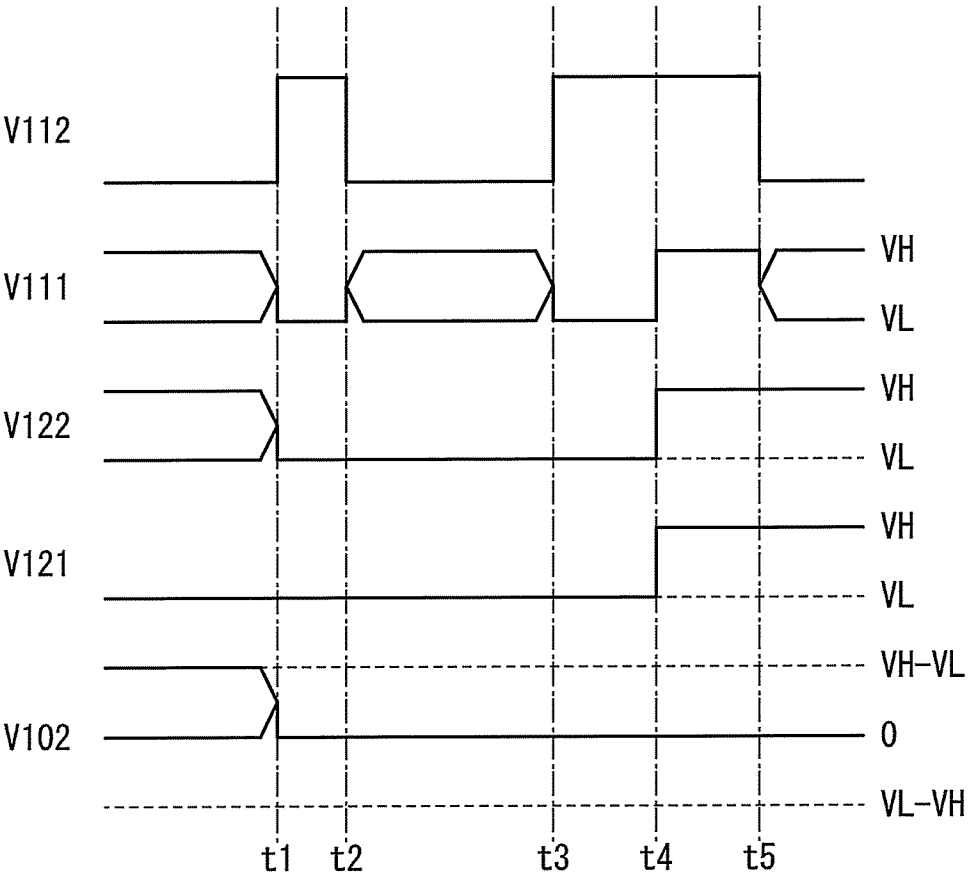
FIG. 2 is an example of a timing chart for explaining operation of a pixel in Embodiment 1.

FIG. 2 is an example of a timing chart for explaining the operation of the pixel in this embodiment. The timing chart in FIG. 2 shows the potential (V112) of the wiring 112, the potential (V111) of the wiring 111, the potential (V122) of the electrode 122, the potential (V121) of the electrode 121, and the voltage (V102) applied to the display element 102. Note that the voltage V102 has a value obtained by subtracting the potential of the electrode 121 from the potential of the electrode 122 (V122−V121).

First, at a time t1, the potential of the wiring 112 becomes H level. Thus, the transistor 101 is turned on, so that electrical continuity is established between the wiring 111 and the electrode 122. Consequently, the potential of the wiring 111 is supplied to the electrode 122. At this time, the potential VL is applied to the electrode 121 and further, the potential VL is also supplied to the wiring 111. Thus, the potential of the electrode 122 becomes equal to the potential VL. In such a manner, zero voltage (also referred to as a voltage of 0 V or a potential difference of 0 V) is applied to the display element 102. After that, this state is maintained until a time t2.

Note that the potential applied to the wiring 111 and the electrode 121 is not limited to the potential VL; it is only necessary that a potential with the same value is applied to the wiring 111 and the electrode 121. In that case also, zero voltage can be applied to the display element 102.

"Selection of a pixel" makes it possible to supply the potential of the wiring 111 to the electrode 122. Specifically, "selection of a pixel" refers to operation in which the transistor 101 is turned on and electrical continuity is established between the wiring 111 and the electrode 122.

"Writing of the potential of the wiring 111 into a pixel" refers to selection of the pixel and supply of the potential of the wiring 111 to the electrode 122. This operation is also expressed by "writing of a signal input to the wiring 111 (e.g., a video signal) into the pixel."

"Application of zero voltage to the display element 102" refers to a state where the potential of the electrode 121 is equal to that of the electrode 122, that is, a state where the potential difference between the electrode 121 and the electrode 122 is equal to 0 V. Note that even in the case of using the expression "application of zero voltage to the display element 102," a voltage lower than a voltage with which the gray level of the display element 102 starts to change (referred to as the threshold voltage of the display element 102) may be applied to the display element 102.

Next, at the time t2, the potential of the wiring 112 becomes L level. Thus, the transistor 101 is turned off, so that electrical continuity between the wiring 111 and the electrode 122 is broken. Consequently, the electrode 122 is placed in a floating state. Note that the capacitor 103 holds the potential difference between the wiring 113 and the electrode 121, so that the potential of the electrode 122 remains equal to the potential VL. For that reason, zero voltage continues to be applied to the display element 102. After that, this state is maintained until a time t3.

In a period (t1 to t2), a pixel is selected and the potential of the wiring 111 is written into the pixel; accordingly, the period (t1 to t2) serves as a selection period or a write period.

Then, at the time t3, the potential of the wiring 112 becomes H level. Thus, the transistor 101 is turned on, so that electrical continuity is established between the wiring 111 and the electrode 122. Consequently, the potential of the wiring 111 is supplied to the electrode 122. At this time, the potential VL is applied to the electrode 121 and further, the potential VL is also supplied to the wiring 111. Thus, the potential of the electrode 122 remains equal to the potential VL. In such a manner, zero voltage continues to be applied to the display element 102. After that, this state is maintained until a time t4.

In a period (t2 to t3), a pixel is not selected, and the potential of the electrode 122 is kept at the potential of the wiring 111, which has been written in the period (t1 to t2). Accordingly, the period (t2 to t3) serves as a non-selection period or a retention period.

Next, at the time t4, the potential VH is applied to the electrode 121. Moreover, the potential VH is applied to the wiring 111 at the same timing. At this time, the potential of the wiring 112 remains at H level. Thus, the transistor 101 remains on, so that electrical continuity between the wiring 111 and the electrode 122 remains established. For that reason, the potential of the wiring 111 continues to be applied to the electrode 122, so that the potential of the electrode 122 becomes equal to the potential VH. In such a manner, zero voltage continues to be applied to the display element 102. After that, this state is maintained until a time t5.

Then, at the time t5, the potential of the wiring 112 becomes L level. Thus, the transistor 101 is turned off, so that electrical continuity between the wiring 111 and the electrode 122 is broken. Consequently, the electrode 122 is placed in a floating state. Since the capacitor 103 holds the potential difference between the wiring 113 and the electrode 121, the potential of the electrode 122 remains approximately equal to VH. In such a manner, zero voltage continues to be applied to the display element 102.

In a period (t3 to t5), a pixel is selected and the potential of the wiring 111 is written into the pixel; accordingly, the period (t3 to t5) serves as a selection period or a write period. Note that the potential of the electrode 121 is inverted in the period (t3 to t5); accordingly, the period (t3 to t5) serves as an inversion period (also referred to as a common inversion period).

As described above, even when the potential of the electrode 121 is inverted, zero voltage can continue to be applied to the display element 102. That is, the potential of the electrode 121 and the potential of the electrode 122 can remain equal to each other. Thus, change in the state of the display element 102 (e.g., change in gray level corresponding to the position of charged particles) due to an electric field generated in the display element 102 can be prevented. Consequently, display unevenness caused when the potential of the electrode 121 is inverted can be prevented. As a result, the display quality can be improved.

Further, inversion of the potential of the electrode 121 can reduce the amplitude of the signal input to the wiring 111; thus, power consumption can be reduced.

Since the amplitude of the signal input to the wiring 111 can be reduced, the signal input to the wiring 111 can have two values (can be a digital signal). Thus, the configuration of the circuit that outputs a signal to the wiring 111 can be simplified.

Moreover, the reduction in amplitude of the signal input to the wiring 111 can decrease the bias voltage of the transistor 101, so that deterioration of the transistor 101 can be suppressed. This makes it easier to use a semiconductor that is more likely to deteriorate than a polycrystalline semiconductor (e.g., an amorphous semiconductor, a microcrystalline semiconductor, or an organic semiconductor) for a semiconductor layer of the transistor 101.

In the case where the transistor 101 is a p-channel transistor, H level and L level of the potential of the wiring 112 are inverted.

Note that the term "potential VH" and the term "potential VL" can be interchanged with each other. In other words, zero voltage can continue to be applied to the display element 102 even when the potential of the electrode 121 is inverted from the value equal to the potential VH to the value equal to the potential VL.

Note that in the period (t2 to t3), a given potential (e.g., the potential VH or the potential VL) is preferably applied to the wiring 111. In particular, a potential equal to the potential that is applied to the wiring 111 in the period (t1 to t2) and/or a period (t3 to t4) is preferably applied to the wiring 111.

The period (t3 to t5) is preferably longer than the period (t1 to t2). This is because the potential of the electrode 122 is controlled in the period (t1 to t2), whereas both the potential of the electrode 121 and the potential of the electrode 122 are controlled in the period (t3 to t5).

The period (t3 to t4) is preferably shorter than the period (t4 to t5). This is because in the period (t3 to t4), a potential is applied to the electrodes 121 and 122 in order to maintain the potentials of these electrodes, whereas in the period (t4 to t5), a potential is applied to the electrodes 121 and 122 in order to invert the potentials of these electrodes.

Note that in the period (t3 to t5), a predetermined potential can be applied to the electrode 121 without inversion of the potential of the electrode 121.

Note that in the period (t3 to t5), the timing at which the potential of the wiring 111 is inverted and the timing at which the potential of the electrode 121 is inverted can vary. In that case, an electric field is generated in the display element 102, so that ions clustering around the charged particles can be separated from the charged particles. The movement speed of the charged particles can thus be increased, so that the response speed of the display element 102 can be increased or afterimages can be reduced. In such a case, the length of the interval between these timings is preferably equal to or smaller than three times that of the period (t1 to t2). More preferably, the interval is equal to or shorter than the period (t1 to t2).

Next, examples of timing charts different from FIG. 2 will be described.

Figure 3:
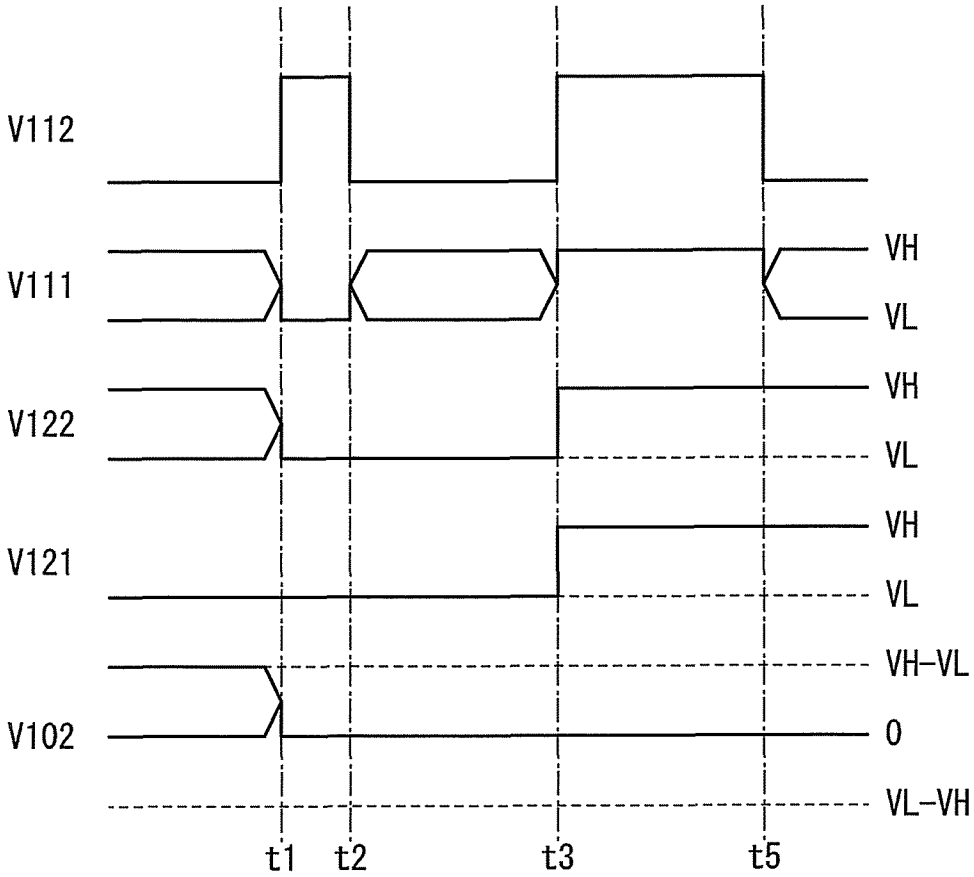
FIG. 3 is an example of a timing chart for explaining operation of a pixel in Embodiment 1.

As illustrated in FIG. 3, the potential of the electrode 121 can be inverted at the time t3. Thus, the period (t3 to t5) can be shortened. Alternatively, power consumption can be reduced because the potential of the wiring 111 is less frequently inverted. However, this embodiment is not limited to this example. For example, the time t4 lies between the time t3 and the time t5.

Figure 4:
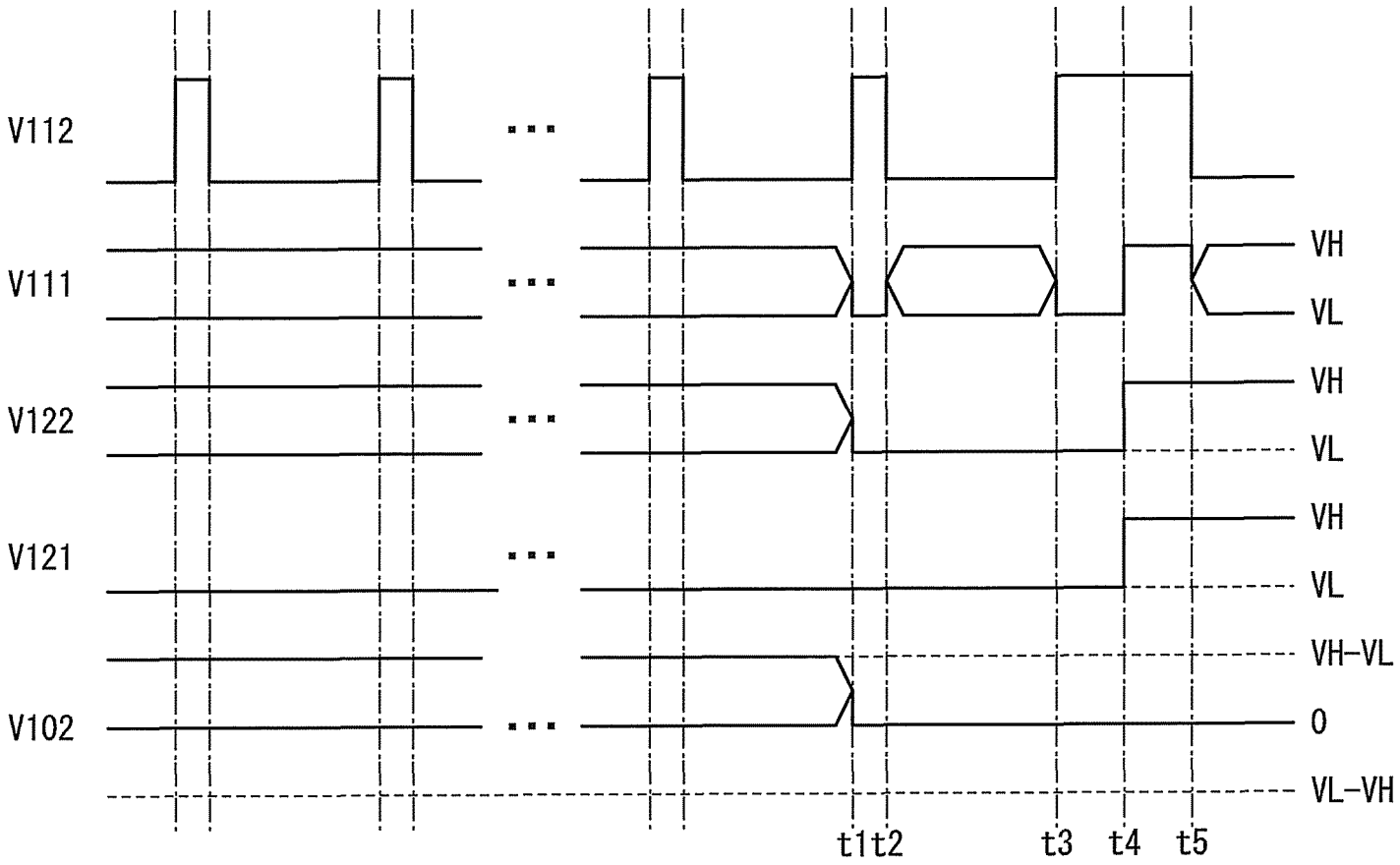
FIG. 4 is an example of a timing chart for explaining operation of a pixel in Embodiment 1.

As illustrated in FIG. 4, a pixel can be selected once or plural times before the time t1 in the timing charts illustrated in FIGS. 2 and 3. In such a case, the potential VL and the potential VH are selectively applied to the wiring 111, and the potential VL is applied to the electrode 121. Thus, zero voltage and a voltage VH-VL can be selectively applied to the display element 102, so that an electric field can be generated in the display element 102. Consequently, the state of the display element 102 can be changed and controlled. Furthermore, zero voltage continues to be applied to the display element 102 in the period (t1 to t5), so that the display element 102 can keep the state before the time t1 even after the time t5.

Note that the voltage VH-VL means that the potential of the electrode 122 is equal to the potential VH and the potential of the electrode 121 is equal to the potential VL.

Figure 5:
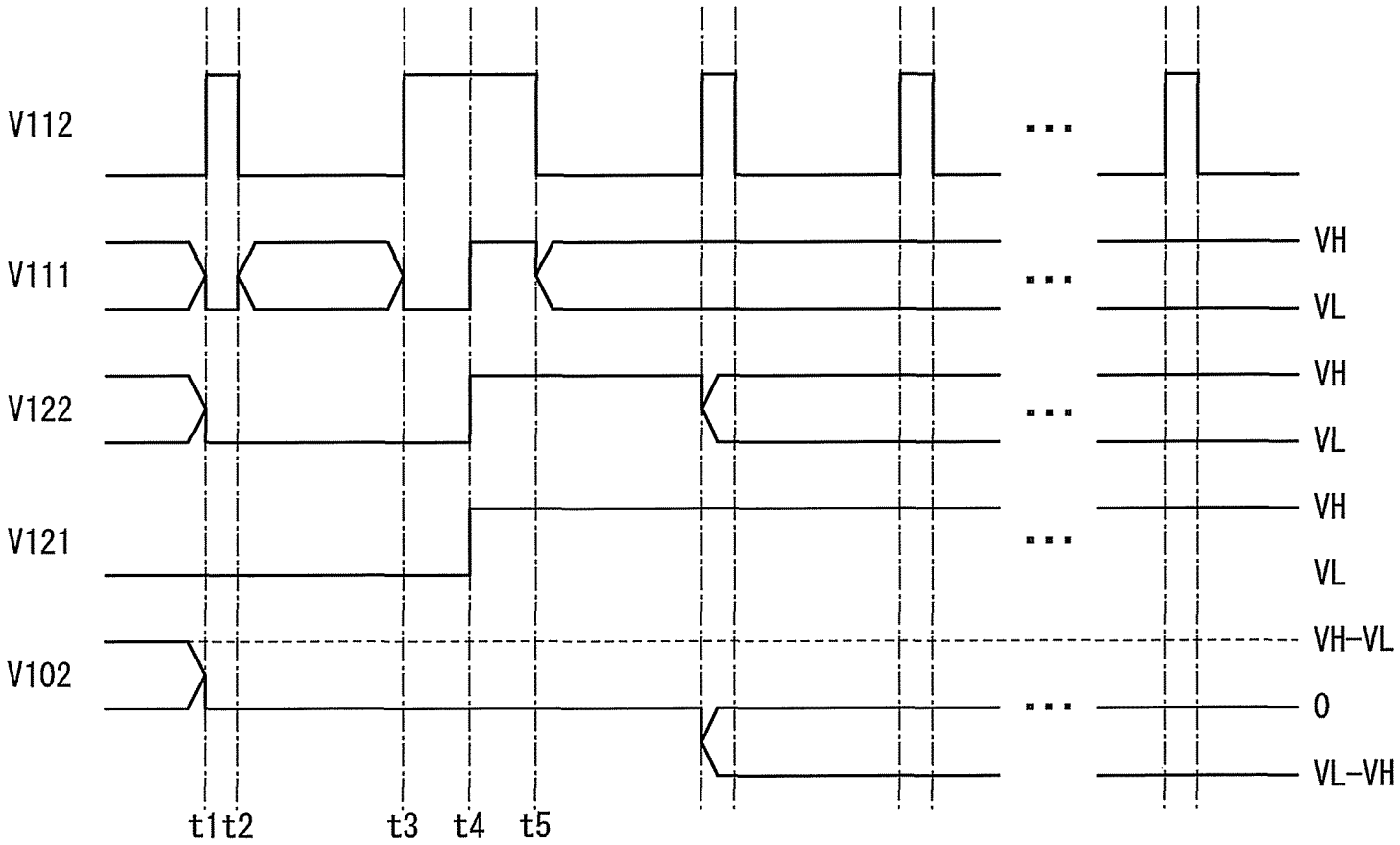
FIG. 5 is an example of a timing chart for explaining operation of a pixel in Embodiment 1.

As illustrated in FIG. 5, a pixel can be selected once or plural times after the time t5 in the timing charts illustrated in FIGS. 2 to 4. In such a case, the potential VL and the potential VH are selectively applied to the wiring 111, and the potential VH is applied to the electrode 121. Thus, zero voltage and a voltage VL-VH can be selectively applied to the display element 102, so that an electric field can be generated in the display element 102. Consequently, the state of the display element 102 can be changed and controlled.

Note that the voltage VL-VH means that the potential of the electrode 122 is equal to the potential VL and the potential of the electrode 121 is equal to the potential VH.

A pixel can be selected once or plural times before the time t1 as illustrated in FIG. 4, and further can be selected once or plural times after the time t5 as illustrated in FIG. 5.

Figure 6:
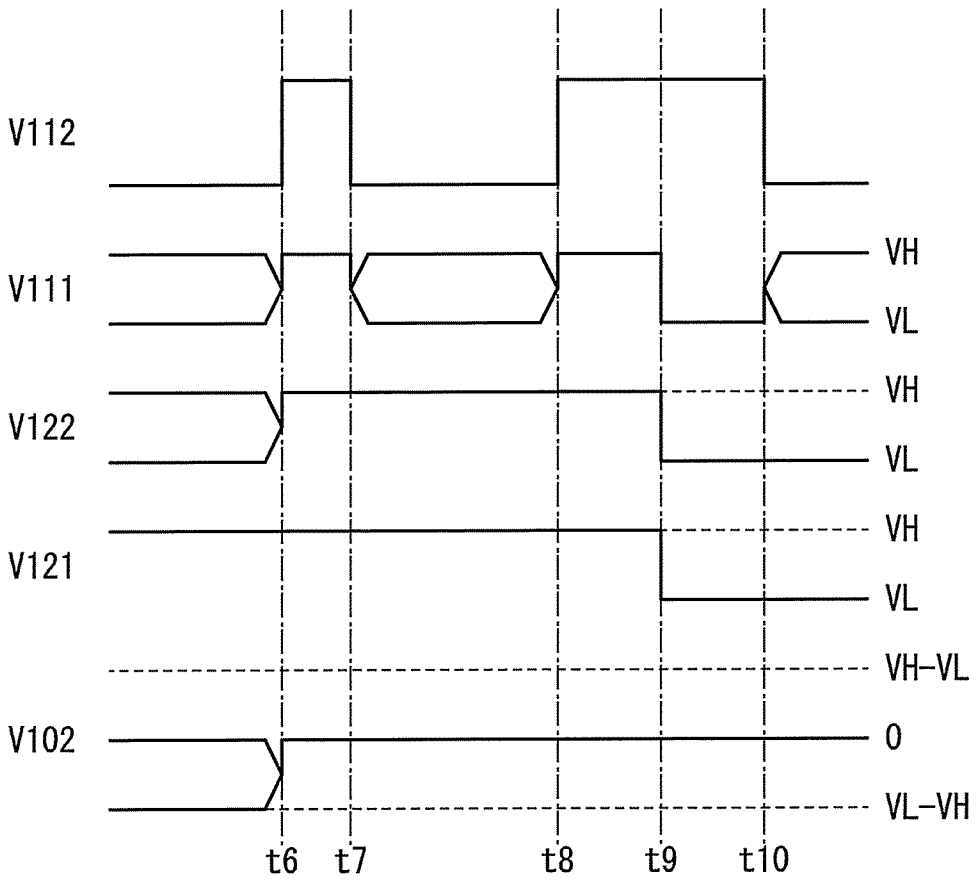
FIG. 6 is an example of a timing chart for explaining operation of a pixel in Embodiment 1.

As illustrated in FIG. 6, the potential VL can be applied to the electrode 121 after application of the potential VH in the timing charts in FIGS. 2 to 5. Times t6 to t10 correspond to the times t1 to t5. The timing chart in FIG. 6 differs from the timing chart in FIG. 2 in that the potential VH and the potential VL that the wiring 111 has are opposite, the potential VH and the potential VL that the electrode 121 has are opposite, and the voltage VH-VL and the voltage VL-VH that are applied to the display element 102 are opposite.

Note that in the timing chart in FIG. 6, the time t9 lies between the time t8 and the time t10 as in FIG. 3. Thus, the potential of the electrode 121 can be VL at the time t8 and the potential of the wiring 111 can be VL at the time t8.

Note that as in FIG. 4, a pixel can be selected once or plural times before the time t6 in the timing chart in FIG. 6. In such a case, the potential VL and the potential VH are selectively applied to the wiring 111, and the potential VH is applied to the electrode 121. Thus, zero voltage and the voltage VL-VH can be selectively applied to the display element 102, so that an electric field can be generated in the display element 102. Consequently, the state of the display element 102 can be changed and controlled. Furthermore, zero voltage continues to be applied to the display element 102 in the period (t6 to t10), so that the display element 102 can keep the state before the time t6 even after the time t10.

Note that as in FIG. 5, a pixel can be selected once or plural times after the time t10 in the timing chart in FIG. 6. In such a case, the potential VL and the potential VH are selectively applied to the wiring 111, and the potential VL is applied to the electrode 121. Thus, zero voltage and the voltage VH-VL can be selectively applied to the display element 102, so that an electric field can be generated in the display element 102. Consequently, the state of the display element 102 can be changed and controlled.

In the timing chart in FIG. 6, a pixel can be selected once or plural times before the time t6, and further can be selected once or plural times after the time t10.

Figure 7:
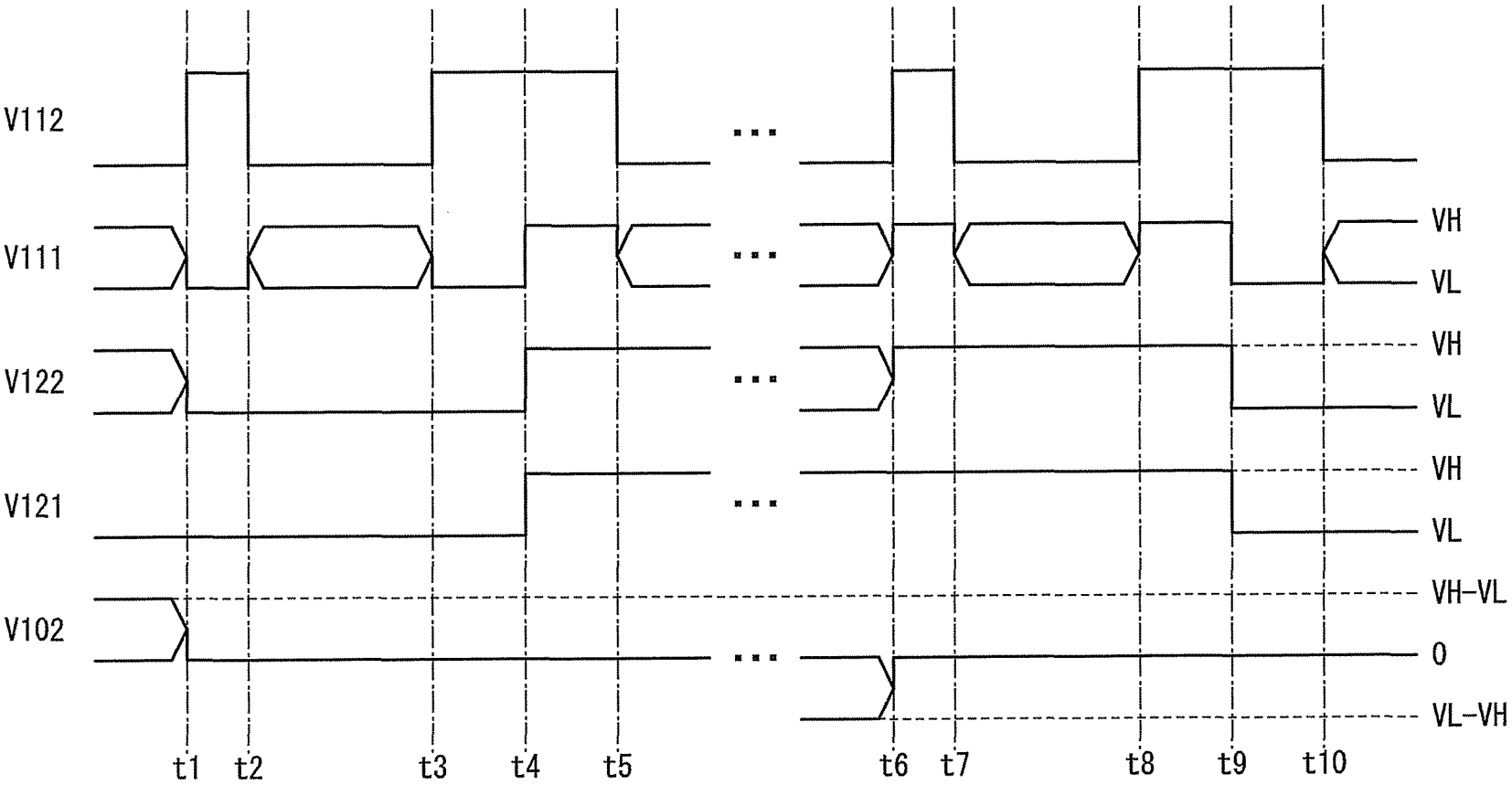
FIG. 7 is an example of a timing chart for explaining operation of a pixel in Embodiment 1.

As illustrated in FIG. 7, change of the potential of the electrode 121 from VL to VH and change of the potential of the electrode 121 from VH to VL can be performed once or repeated plural times. FIG. 7 illustrates an example of a timing chart in the case where the potential of the electrode 121 is changed from VH to VL after being changed from VL to VH.

Next, an example of specific operation of the pixel in this embodiment will be described.

Figure 8:
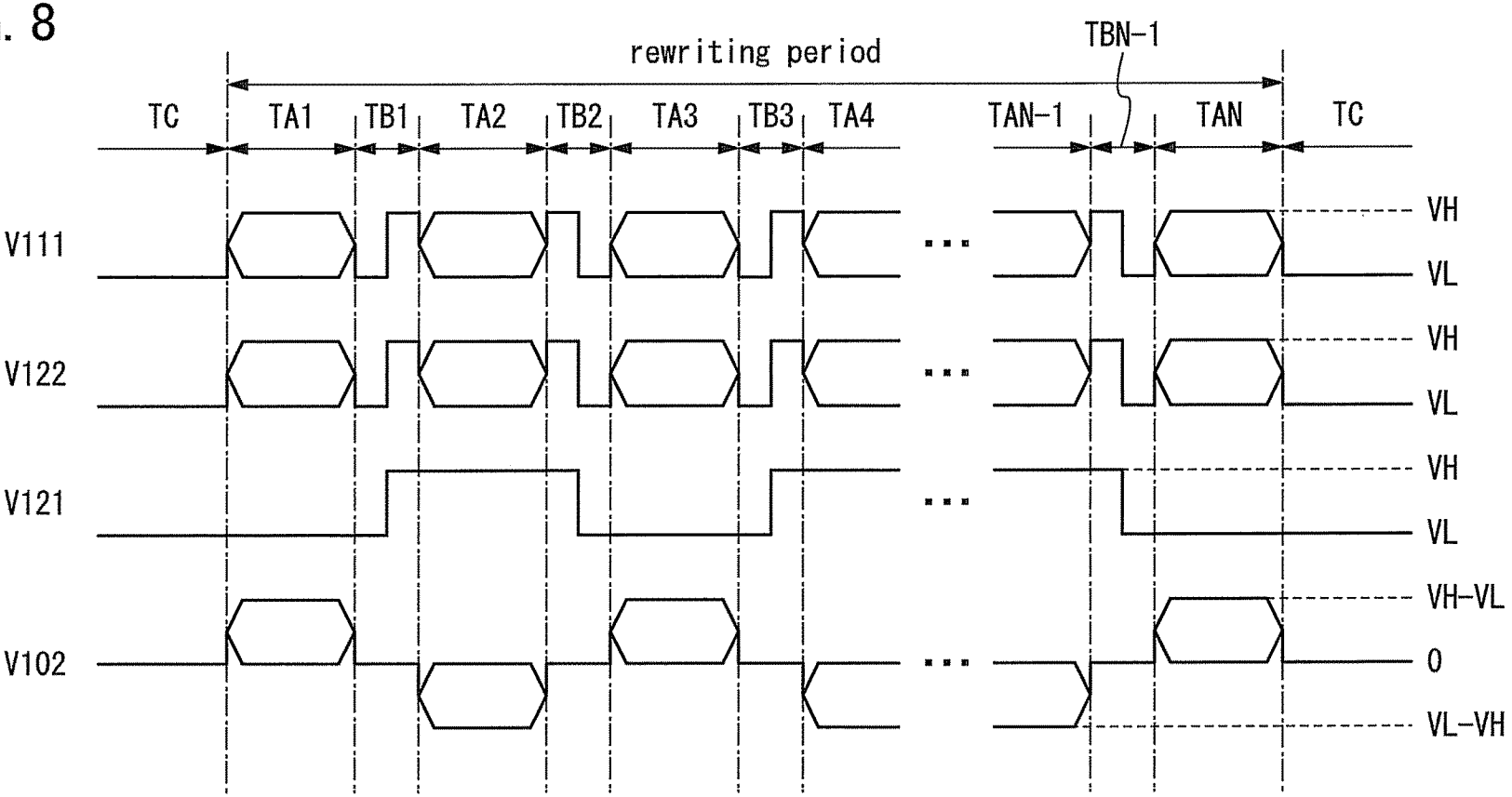
FIG. 8 is an example of a timing chart for explaining operation of a pixel in Embodiment 1.

FIG. 8 is an example of a timing chart for explaining operation of the pixel in this embodiment. The timing chart in FIG. 8 shows the potential of the wiring 111, the potential of the electrode 122, the potential of the electrode 121, and the voltage applied to the display element 102. The timing chart in FIG. 8 has N number of periods TA (the periods $TA_1$ to $TA_N$, where N is a natural number), N−1 number of periods TB (the periods $TB_1$ to $TB_{N-1}$), and periods TC. In the timing chart in FIG. 8, the periods TA and the periods TB are alternately arranged, and the periods TC are also arranged.

First, in the period TA, zero voltage and the voltage VH-VL are selectively applied to the display element 102, or alternatively, zero voltage and the voltage VL-VH are selectively applied to the display element 102. For example, the state of the display element 102 is not changed when zero voltage is applied to the display element 102, whereas the state of the display element 102 is changed when the voltage VH-VL or the voltage VL-VH is applied to the display element 102. By thus applying two kinds of voltages selectively to the display element 102, the state of the display element 102 can be controlled. Accordingly, the gray level of the display element 102 can be set to a desired gray level. Alternatively, an afterimage can be prevented by initializing the display element 102.

Note that when the voltage VH-VL is applied to the display element 102, the gray level of the display element 102 is closer to a first gray level (e.g., one of black and white), whereas when the voltage VL-VH is applied to the display element 102, the gray level of the display element 102 is closer to a second gray level (e.g., the other of black and white).

Note that the period TA corresponds to a period before the time t1, a period after the time t5, a period before the time t6, a period after the time t10, or a period between the time t5 and the time t6 illustrated in FIGS. 2 to 7.

Next, in the period TB, the potential of the electrode 121 is inverted. Specifically, the potential of the electrode 121 is inverted while zero voltage continues to be applied to the display element 102. In other words, the period TB corresponds to the period (t1 to t5) or the period (t6 to t10) illustrated FIGS. 2 to 7; therefore, the description of the operation of the pixel in the period TB is omitted.

The state of the display element 102 can be controlled by repeating the period TA and the period TB; therefore, the periods TA and the periods TB are collectively referred to as a rewrite period or an address period.

Note that when a pixel is selected for the last time in the period TA that is placed at the end of the rewrite period, it is preferable that a potential same as that of the electrode 121 be applied to the wiring 111. That is, the potential same as that of the electrode 121 is preferably written into the pixel. Consequently, the rewrite period can be finished while zero voltage continues to be applied to the display element 102. Thus, the state of the display element 102 can be maintained until a rewrite period starts again. However, this embodiment is not limited to this example. For example, if the period TB is additionally placed at the end of the rewrite period, the rewrite period can be finished while zero voltage continues to be applied to the display element 102. In that case, the periods TA and the periods TB are often equal in number. Further, when a pixel is selected for the last time in the period TA that is placed at the end of the rewrite period, the potential VH and the potential VL can be selectively applied to the wiring 111. Thus, the state of the display element 102 can be controlled more minutely.

Then, in the period TC, the state of the display element 102 is held by continuous application of zero voltage to the display element 102. For example, in order to keep applying zero voltage to the display element 102, the rewrite period is finished while zero voltage continues to be applied to the display element 102, and selection of a pixel is not performed in the period TC. Accordingly, in the period TC, the potential of the wiring 112 is set at L level (H level in the case where the transistor 101 is a p-channel transistor).

Note that in the period TC, a potential same as that of the electrode 121 is preferably applied to the wiring 111; accordingly, the potential of the electrode 122 can be prevented from being changed by leakage current or the like. Alternatively, the potential of the electrode 122 can be returned to the potential of the wiring 111 (the potential of the electrode 121) even if it is changed by feedthrough effects or the like. In such a manner, generation of an electric field in the display element 102 can be suppressed, so that the state of the display element 102 can be maintained more easily. That is, since deterioration of the display element 102 over time can be suppressed, the display quality can be improved.

Note that in the period TC, a potential same as that of the wiring 111 can be applied to the wiring 112. Accordingly, the bias voltage of the transistor 101 can be zero, so that deterioration of the transistor 101 can be suppressed. In particular, shift of the threshold voltage of the transistor 101 can be suppressed.

Note that in the period TC, the wiring 111, the wiring 112, and/or the electrode 121 can be placed in a floating state with no potential applied. That is, it is possible to stop supply of a signal, voltage, or the like to the wiring 111, the wiring 112, and/or the electrode 121. Thus, power consumption of a driver circuit for driving pixels, for example, can be reduced.

Note that in the period TC, the same potential can be applied to the wiring 111, the wiring 112, and the electrode 121; accordingly, change of the potentials of these wirings and electrode can be suppressed. Although not particularly limited, the potential applied to the wiring 111, the wiring 112, and the electrode 121 preferably has a value equal to the ground.

As described above, with an appropriate combination of the periods TA and the periods TB in the rewrite period, the state of the display element 102 can be freely changed. In addition, the state can be maintained in the period TC.

Then, specific examples of timing charts of the period TA will be described with reference to FIGS. 9A and 10A. The timing charts in FIGS. 9A and 10A each show the potential of the wiring 112, the potential of the wiring 111, the potential of the electrode 122, the potential of the electrode 121, and the voltage applied to the display element 102.

Figure 9A:
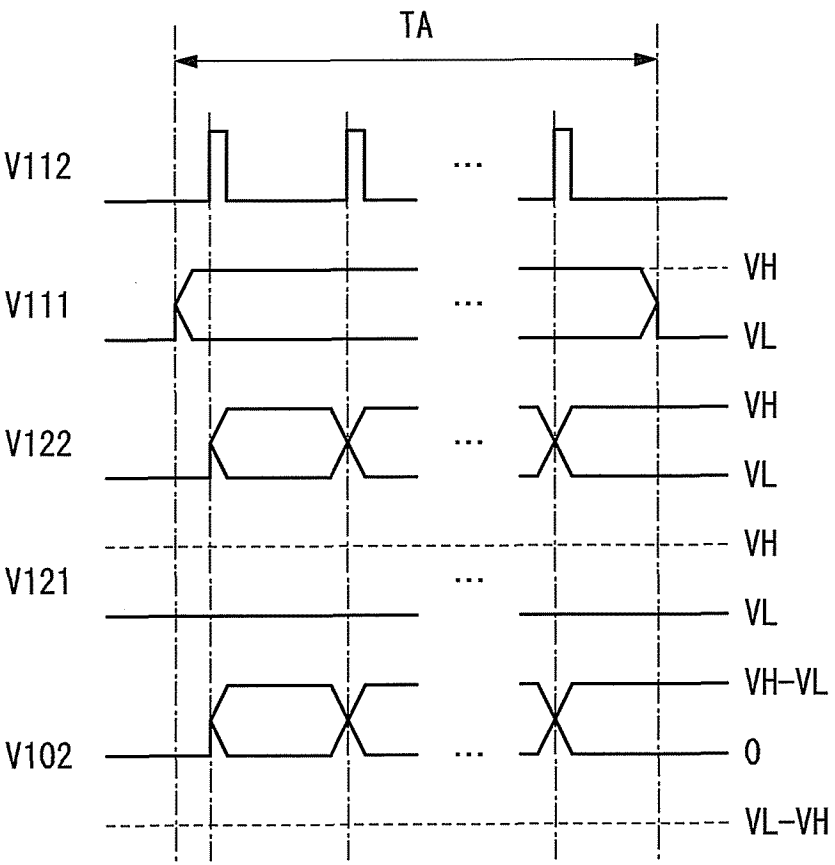
FIGS. 9A and 9B are examples of timing charts each explaining operation of a pixel in Embodiment 1.

FIG. 9A is a timing chart of the period TA in the case where the potential VL is applied to the electrode 121. The potential VL is applied to the electrode 121, and the potential VH and the potential VL are selectively applied to the wiring 111. A pixel is selected once or plural times. When a pixel is selected, the potential of the wiring 111 at that time is written into the pixel. Since the potential VH and the potential VL are selectively applied to the wiring 111 and the potential VL is applied to the electrode 121, zero voltage and the voltage VH-VL are selectively applied to the display element 102. After that, the potential of the electrode 121 is kept at the written potential, which is of the wiring 111, until the pixel is selected again. That is, zero voltage or the voltage VH-VL continues to be applied to the display element 102. As described above, zero voltage and the voltage VH-VL are selectively applied to the display element 102 every time the pixel is selected, whereby the voltage applied to the display element 102 can be controlled. In the case where a pixel is selected plural times, the time during which zero voltage or the voltage VH-VL is applied to the display element 102 can be controlled. Thus, the state of the display element 102 can be minutely controlled, leading to the increase in the number of gray levels or prevention of afterimages. Note that when a pixel is selected too frequently, the time for changing the gray level of the display element 102 is too long. Therefore, the number of times a pixel is selected is preferably once or 2 to 30 times, more preferably 5 to 25 times, further preferably 10 to 20 times.

In the case where a pixel is selected plural times, when the length of the time after the pixel is selected until the pixel is selected again is fixed, a synchronization signal of a circuit that outputs a signal to the pixel (e.g., a driver circuit such as a signal line driver circuit or a scan line driver circuit) can have a fixed frequency.

Figure 10A:
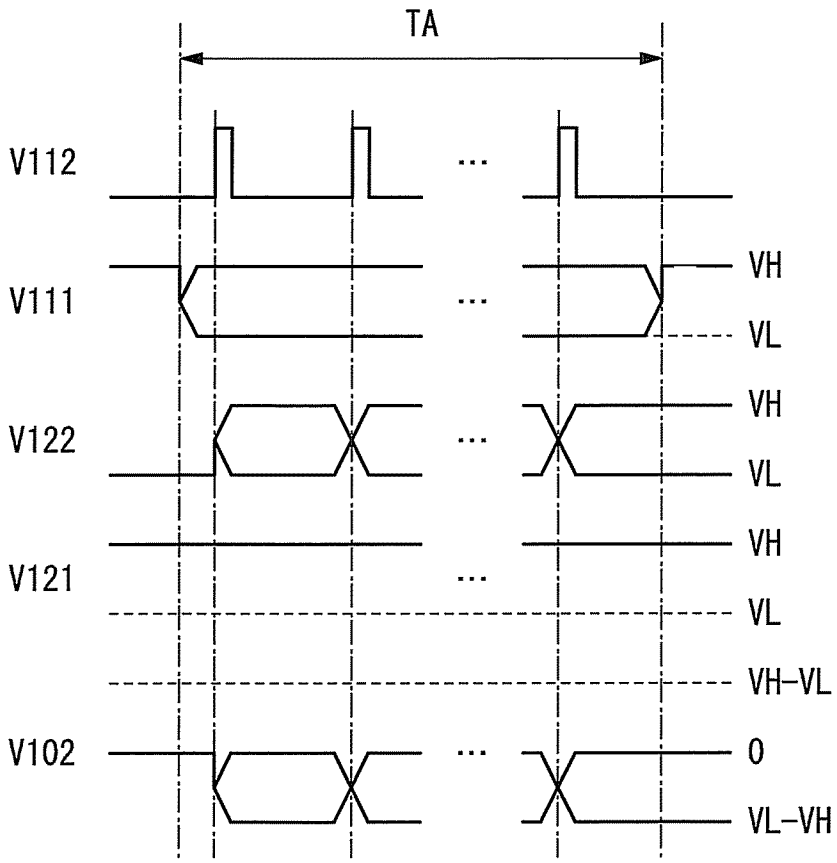
FIGS. 10A and 10B are examples of timing charts each explaining operation of a pixel in Embodiment 1.

FIG. 10A differs from FIG. 9A in that the potential VH is applied to the electrode 121 and zero voltage and the voltage VL-VH are selectively applied to the display element 102.

Figure 9B:
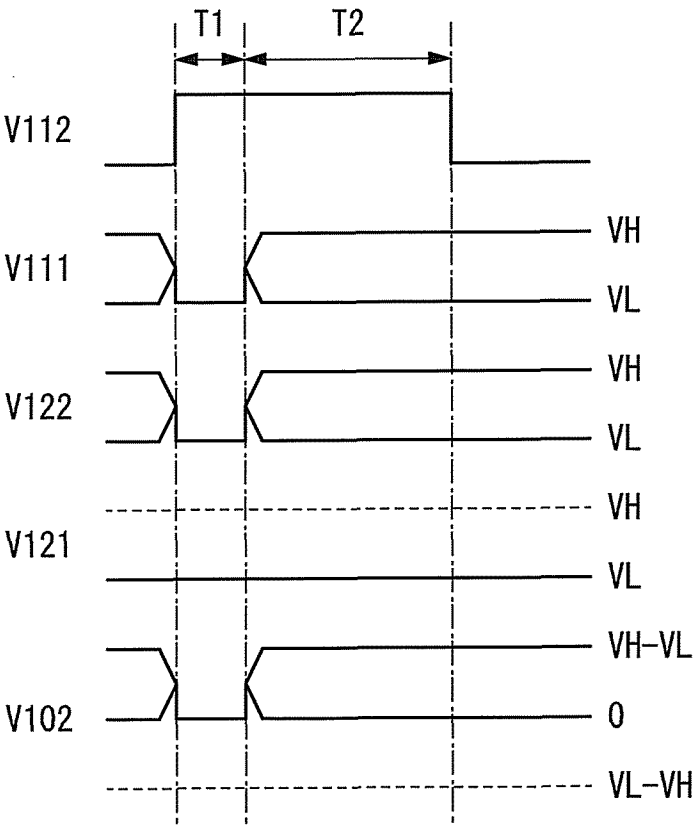
Figure 10B:
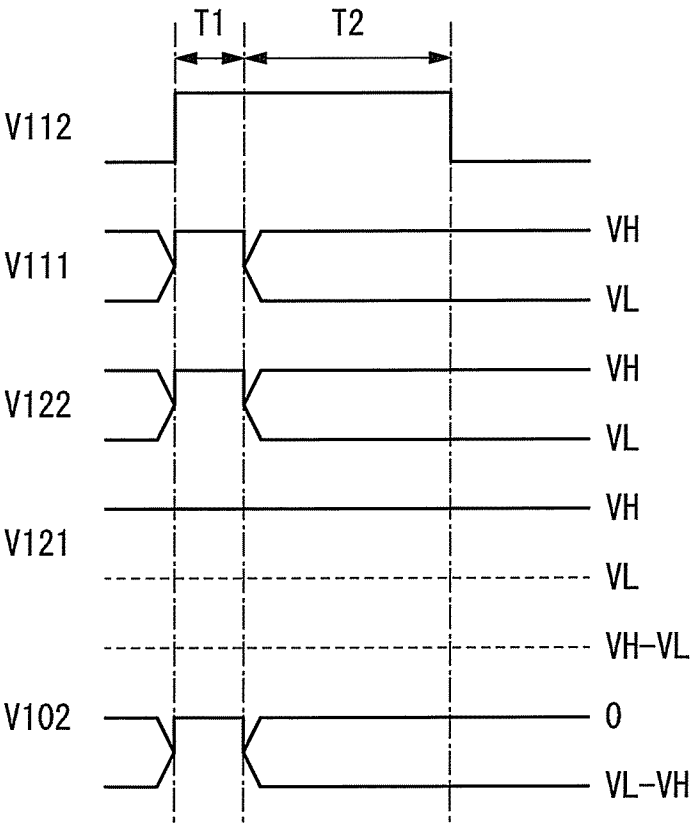

As illustrated in FIGS. 9B and 10B, a potential same as that of the electrode 121 can be applied to the wiring 111 in the former part of a selection period (e.g., a period during which the potential of the wiring 112 is at H level). A period T1 is a period during which a potential same as that of the electrode 121 is applied to the wiring 111. A period T2 is a period during which the potential VH and the potential VL are selectively applied to the wiring 111. In such a manner, the voltage applied to the display element 102 can be changed even when the same potential continues to be applied to a pixel; thus, afterimages can be reduced. Alternatively, the response speed can be increased or variation in response speed between pixels can be reduced; thus, unevenness or afterimages can be prevented. Note that the period T2 becomes short in some cases when the period T1 is too long; in that case, the potential of the wiring 111 cannot be rewritten into a pixel in the period T2 in some cases. Therefore, the period T1 is preferably shorter than the period T2. Specifically, the period T1 accounts for preferably 1 to 20%, more preferably 2 to 15%, further preferably 3 to 10% of the selection period.

Figure 11:
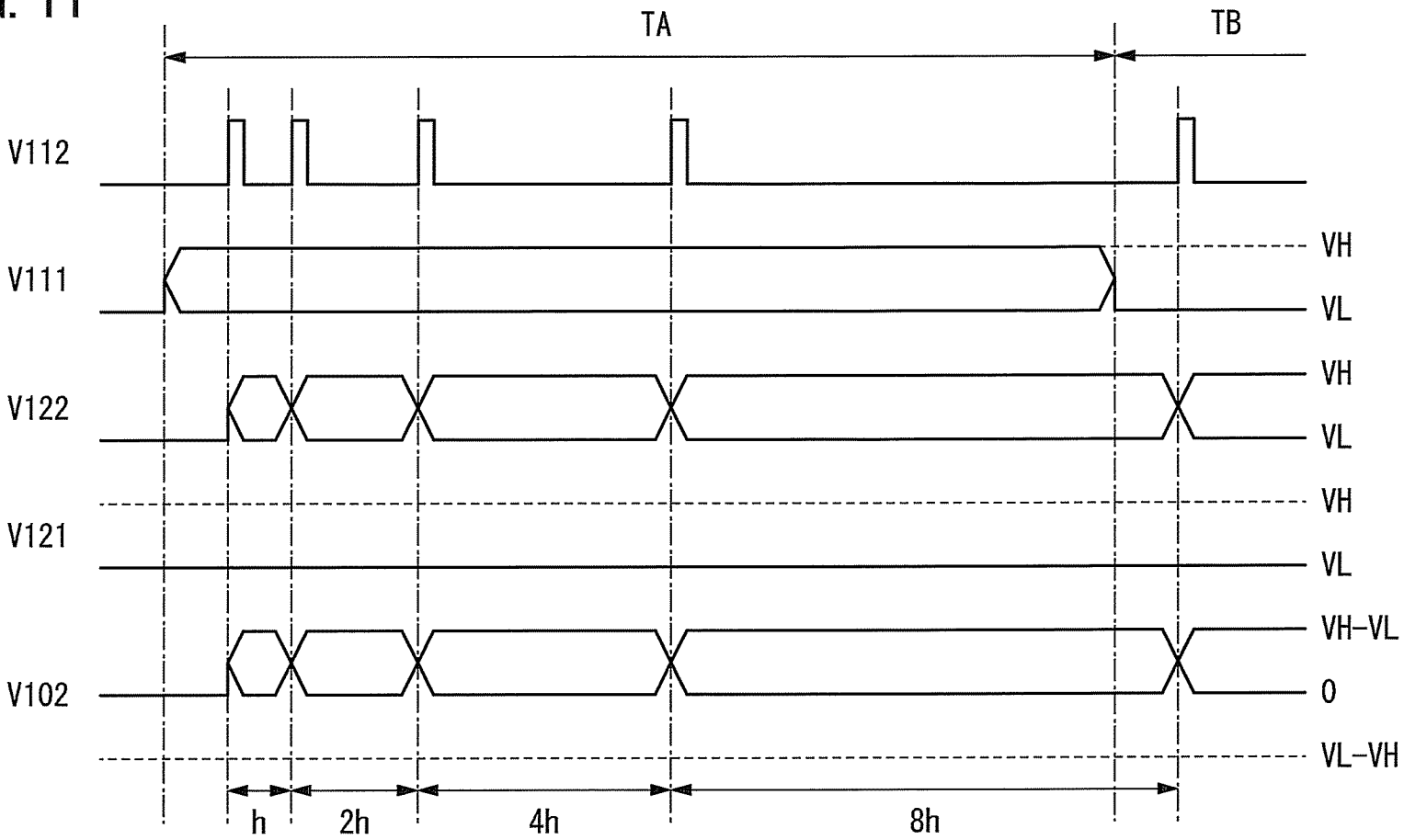
FIG. 11 is an example of a timing chart for explaining operation of a pixel in Embodiment 1.

As illustrated in FIG. 11, the time after a pixel is selected until the pixel is selected again can vary, and specifically can be weighted. FIG. 11 illustrates an example of the case where the potential VL is applied to the electrode 121 and a pixel is selected four times in the period TA. First, the time after a pixel is selected for the first time until the pixel is selected for the second time is denoted by a time h. In that case, the time after the pixel is selected for the second time until the pixel is selected for the third time is denoted by a time 2h (twice as long as the time h). The time after the pixel is selected for the third time until the pixel is selected for the fourth time is denoted by a time 4h (four times as long as the time h). The time after the pixel is selected for the fourth time until the pixel is selected in the period TB subsequent to the period TA is denoted by a time 8h (eight times as long as the time h). In the above manner, the time after the pixel is selected until the pixel is selected again is weighted (e.g., 1:2:4:8). Thus, the number of times a pixel is selected can be reduced, and the time for applying the voltage to the display element 102 can be minutely controlled.

Figure 12:
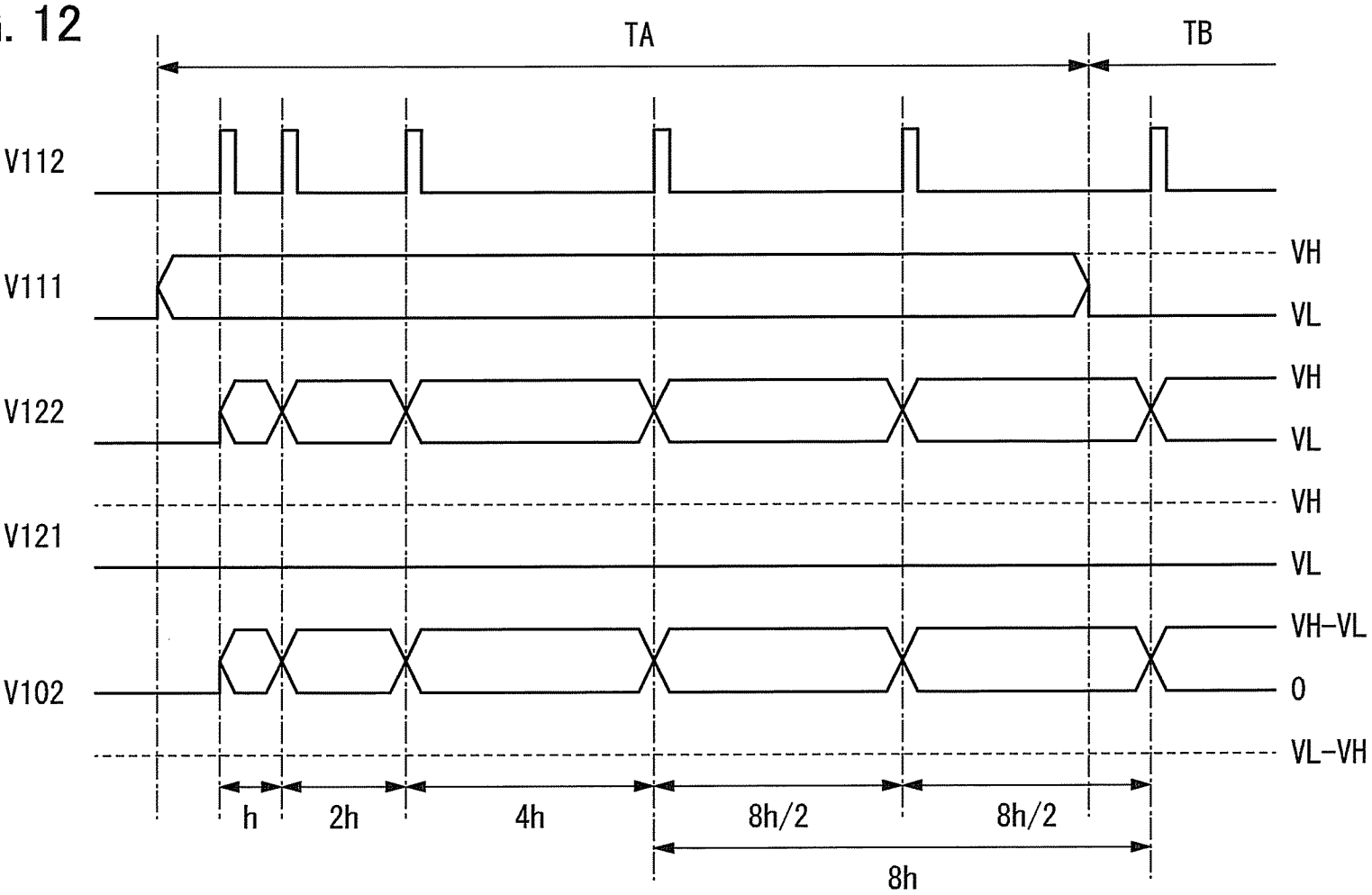
FIG. 12 is an example of a timing chart for explaining operation of a pixel in Embodiment 1.

The time after the pixel is selected until the pixel is selected again can be divided as illustrated in FIG. 12. In FIG. 12, as an example, the time 8h (the time after the pixel is selected for the fourth time until the pixel is selected in the period TB subsequent to the period TA) is divided into two: a time 4h and a time 4h. Accordingly, the time during which the capacitor holds the potential of the wiring 111 written into the pixel can be shortened in the selection period. For that reason, the capacitor can be reduced in size, so that the area of the pixel can be decreased.

Next, a specific example of the timing chart in FIG. 8 will be described.

First, as an example, the case where the period $TA_1$, the period $TB_1$, the period $TA_2$, the period $TB_2$, and the period $TA_3$ are arranged in this order in the rewrite period will be described with reference to FIG. 13. The timing chart in FIG. 13 is a specific example of the timing chart in FIG. 8; this embodiment is not limited to this.

Figure 13:
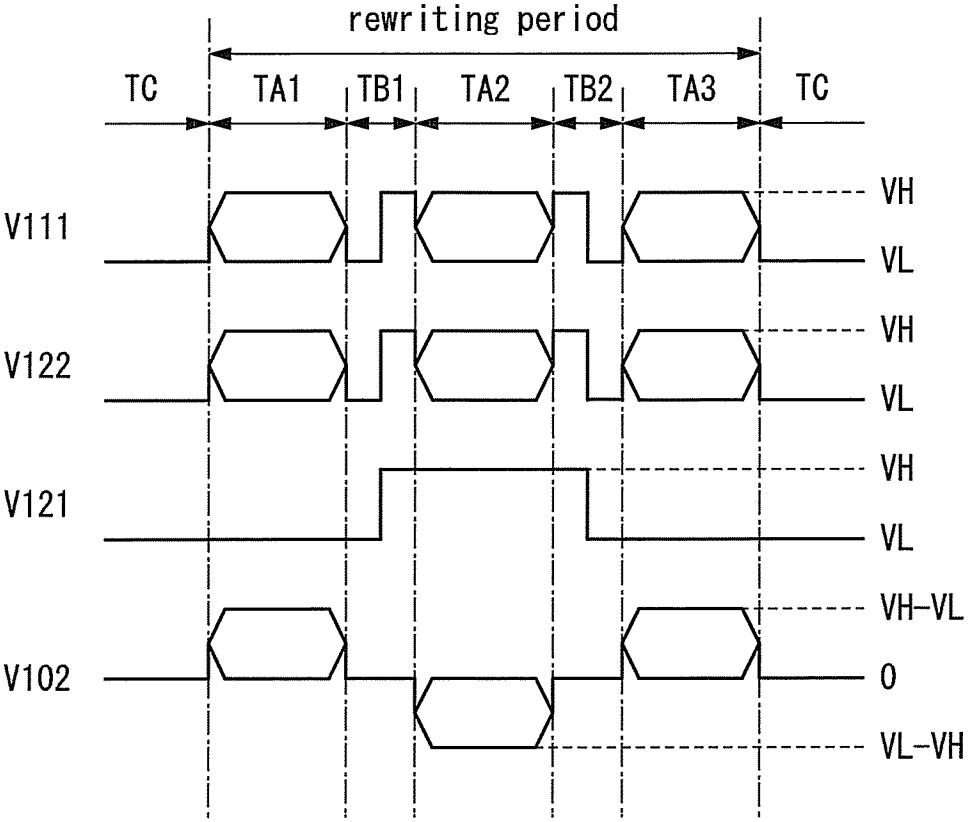
FIG. 13 is an example of a timing chart for explaining operation of a pixel in Embodiment 1.

A rewrite period illustrated in FIG. 13 is referred to as this rewrite period. A rewrite period before the rewrite period illustrated in FIG. 13 is referred to as a preceding rewrite period.

The gray level of the display element 102 determined in this rewrite period is called "an original gray level" of the display element 102. The gray level of the display element 102 determined in the preceding rewrite period is called "a previous gray level" of the display element 102.

First, in the period $TA_1$, the potential VL is applied to the electrode 121, so that zero voltage and the voltage VH-VL are selectively applied to the display element 102. Here, the length of time or the number of times of application of the voltage VH-VL to the display element 102 depends on the previous gray level of the display element 102. In the period $TA_1$ of this rewrite period, the length of time or the number of times of application of the voltage VH-VL is preferably smaller in any of the following cases, for example: in the preceding rewrite period, when the length of time or the number of times of application of the voltage VH-VL to the display element 102 is larger; when the length of time or the number of times of application of the voltage VL-VH to the display element 102 is smaller; when a time subtracting the time for applying the voltage VL-VH to the display element 102 from the time for applying the voltage VH-VL is longer; and when a value obtained by subtracting the number of times of application of the voltage VL-VH to the display element 102 from the number of times of application of the voltage VH-VL is larger. Therefore, an afterimage due to the previous gray level of the display element 102 can be suppressed. Since the display element 102 can be initialized in the period $TA_1$ in the above manner, the period $TA_1$ is referred to as an initialization period.

Next, in the period $TB_1$, the potential of the electrode 121 is inverted while zero voltage continues to be applied to the display element 102.

Next, in the period $TA_2$, the potential VH is applied to the electrode 121, so that zero voltage and the voltage VL-VH are selectively applied to the display element 102. Here, the length of Vane or the number of times of application of the voltage VL-VH to the display element 102 depends on the previous gray level of the display element 102. In the period $TA_2$ of this rewrite period, the length of time or the number of times of application of the voltage VL-VH is preferably smaller in any of the following cases, for example: in the preceding rewrite period, when the length of time or the number of times of application of the voltage VH-VL to the display element 102 is smaller; when the length of time or the number of times of application of the voltage VL-VH to the display element 102 is larger; when a time subtracting the time for applying the voltage VL-VH to the display element 102 from the time for applying the voltage VH-VL is shorter; and when a value obtained by subtracting the number of times of application of the voltage VL-VH to the display element 102 from the number of times of application of the voltage VH-VL is smaller. Therefore, an afterimage due to the previous gray level of the display element 102 can be suppressed. Since the display element 102 can be initialized in the period $TA_2$ in the above manner, the period $TA_2$ can be referred to as an initialization period.

Next, in the period $TB_2$, the potential of the electrode 121 is inverted while zero voltage continues to be applied to the display element 102.

Next, in the period $TA_3$, the potential VL is applied to the electrode 121, so that zero voltage and the voltage VH-VL are selectively applied to the display element 102. The length of time or the number of times of application of the voltage VH-VL to the display element 102 depends on the original gray level of the display element 102. The length of time or the number of times of application of the voltage VH-VL is preferably larger as the original gray level of the display element 102 is closer to the first gray level.

In the timing chart in FIG. 13, the period $TA_3$ is placed at the end of the rewrite period. For that reason, when a pixel is selected for the last time in the period $TA_3$, the wiring 111 is preferably supplied with a potential same as that of the electrode 121 (e.g., the potential VL).

The pixel can be initialized in the above manner, so that an afterimage due to the previous gray level of the display element 102 can be suppressed. Specifically, an afterimage can be further suppressed in the following manner: the voltage applied to the display element 102 and the time for applying the voltage are changed in accordance with the previous gray level of the display element 102.

Note that a difference between the length of time or the number of times of application of the voltage VH-VL to the display element 102 in the period $TA_1$ and that of the voltage VL-VH to the display element 102 in the period $TA_2$ can depend on the previous gray level of the display element 102. In particular, the difference in the length of time or the number of times can depend on the length of time or the number of times of application of the voltage VH-VL to the display element 102 in the period $TA_3$ of the preceding rewrite period. For example, as the length of time or the number of times of application of the voltage VH-VL to the display element 102 in the period $TA_3$ of the preceding rewrite period is larger, a time subtracting the time of application of the voltage VL-VH to the display element 102 in the period $TA_2$ from that of the voltage VH-VL to the display element 102 in the period $TA_1$ is preferably shorter. As another example, as the length of time or the number of times of application of the voltage VH-VL to the display element 102 in the period $TA_3$ of the preceding rewrite period is larger, a value obtained by subtracting the number of times of application of the voltage VL-VH to the display element 102 in the period $TA_2$ from that of the voltage VH-VL to the display element 102 in the period $TA_1$ is preferably smaller.

The length of time or the number of times of application of the voltage VH-VL to the display element 102 in the period $TA_1$ can depend on the original gray level of the display element 102. Alternatively, the length of time or the number of times of application of the voltage VL-VH to the display element 102 in the period $TA_2$ can depend on the original gray level of the display element 102. Alternatively, a difference between the length of time or the number of times of application of the voltage VH-VL to the display element 102 in the period $TA_1$ and that of the voltage VL-VH to the display element 102 in the period $TA_2$ can depend on the original gray level of the display element 102. Thus, the number of gray levels of the display element 102 can be further increased.

(Embodiment 2)

In this embodiment, an example of a display device and an example of a method for driving the display device will be described. Specifically, an example of a display device including the pixel in Embodiment 1 and an example of a method for driving the display device will be described.

Figure 14:
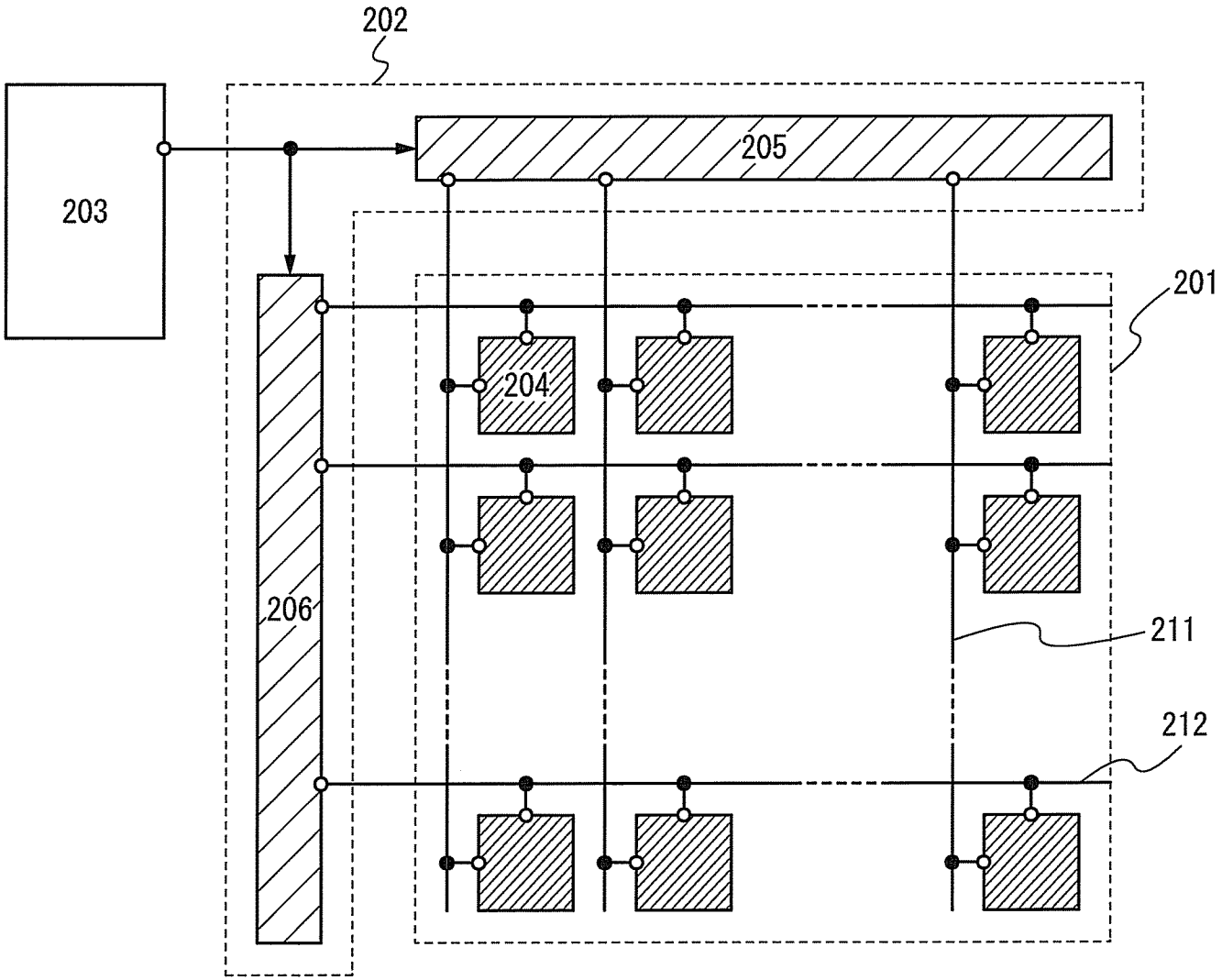
FIG. 14 is an example of a block diagram of a display device in Embodiment 2.

FIG. 14 illustrates an example of a block diagram of a display device in this embodiment. The display device in FIG. 14 includes a pixel portion 201, a driver circuit 202, and a controller 203. The pixel portion 201 includes a plurality of pixels 204. The driver circuit 202 includes a signal line driver circuit (also referred to as a source driver circuit) 205 and a scan line driver circuit (also referred to as a gate driver circuit) 206. In the pixel portion 201, a plurality of wirings 211 (the wirings $\mathbf{211}_1$ to $\mathbf{211}_n$) are extended from the signal line driver circuit 205, and a plurality of wirings 212 (the wirings $\mathbf{212}_1$ to $\mathbf{212}_m$) are extended from the scan line driver circuit 206. The plurality of pixels 204 are placed at intersections of the plurality of wirings 211 and the plurality of wirings 212. For example, the pixel $\mathbf{204}_{ji}$ (j is one of 1 to n and i is one of 1 to m) is placed at the intersection of the wiring $\mathbf{211}_j$ and the wiring $\mathbf{212}_i$ and connected to the wirings $\mathbf{211}_j$ and $\mathbf{212}_i$.

In the pixel portion 201, a variety of wirings other than the wirings 211 and 212 (e.g., a capacitor line, a power supply line, and/or a gate signal line) can be provided.

As the pixel 204, the pixel in Embodiment 1 is used. Therefore, the wiring 211 and the wiring 212 correspond to the wiring 111 and the wiring 112, respectively, in the pixel in Embodiment 1 and have the same functions as the respective wirings 111 and 112. Note that without limitation to the pixel in Embodiment 1, a variety of other pixels can be used as the pixel 204. In FIG. 14, a wiring corresponding to the wiring 113, an electrode corresponding to the electrode 121, and the like are omitted.

The signal line driver circuit 205 outputs a signal (e.g., a video signal) to the plurality of wirings 211. The potential VH and the potential VL are selectively applied to the wirings 211 by the signal line driver circuit 205.

Note that the signal line driver circuit 205 outputs signals to the wirings $\mathbf{211}_1$ to $\mathbf{211}_n$ at the same timing; thus, the time during which the signal is written into each pixel 204 can be extended. For that reason, the capacitance of a capacitor included in each pixel 204 can be increased. However, this embodiment is not limited to this example. For example, the signal line driver circuit 205 can sequentially output signals to the wirings $\mathbf{211}_1$ to $\mathbf{211}_n$ on a per column basis or every plural columns. In that case, the structure of the signal line driver circuit 205 can be simplified, so that the signal line driver circuit 205 or part thereof can be easily formed over a substrate where the pixel portion 201 is formed.

The scan line driver circuit 206 outputs a signal (e.g., a gate signal) to the plurality of wirings 212 and controls the potentials of the plurality of wirings 212. In this manner, the scan line driver circuit 206 determines whether to select the pixel 204 or not. The scan line driver circuit 206 sequentially selects (scans) the pixels 204 from the pixels in the first row. Moreover, the scan line driver circuit 206 has a function of concurrently selecting the pixels of all rows, that is, all the pixels. Thus, the driving method in Embodiment 1 can be realized. However, this embodiment is not limited to this example. For example, the scan line driver circuit 206 can select the pixels 204 placed in each row in a variety of orders. In that case, the scan line driver circuit 206 often includes a decoder circuit. As another example, in part of a period for selecting the pixels 204 in the i-th row, the scan line driver circuit 206 can select the pixels 204 in the (i+1)th row and/or the pixels 204 in the (i−1)th row; thus, the potential of the wiring 211 which is written into the pixels 204 in the (i−1)th row can be input to the pixels 204 in the i-th row as a precharge voltage. As another example, the scan line driver circuit 206 can sequentially select only pixels placed in some of rows, for example, selects only rows including pixels whose gray level is to be rewritten. Thus, partial driving can be realized, leading to a reduction in power consumption.

The controller 203 outputs a signal to the signal line driver circuit 205 and the scan line driver circuit 206 and controls the timing of operation of these driver circuits.

Next, an example of operation of the display device in this embodiment will be described.

Figure 15:
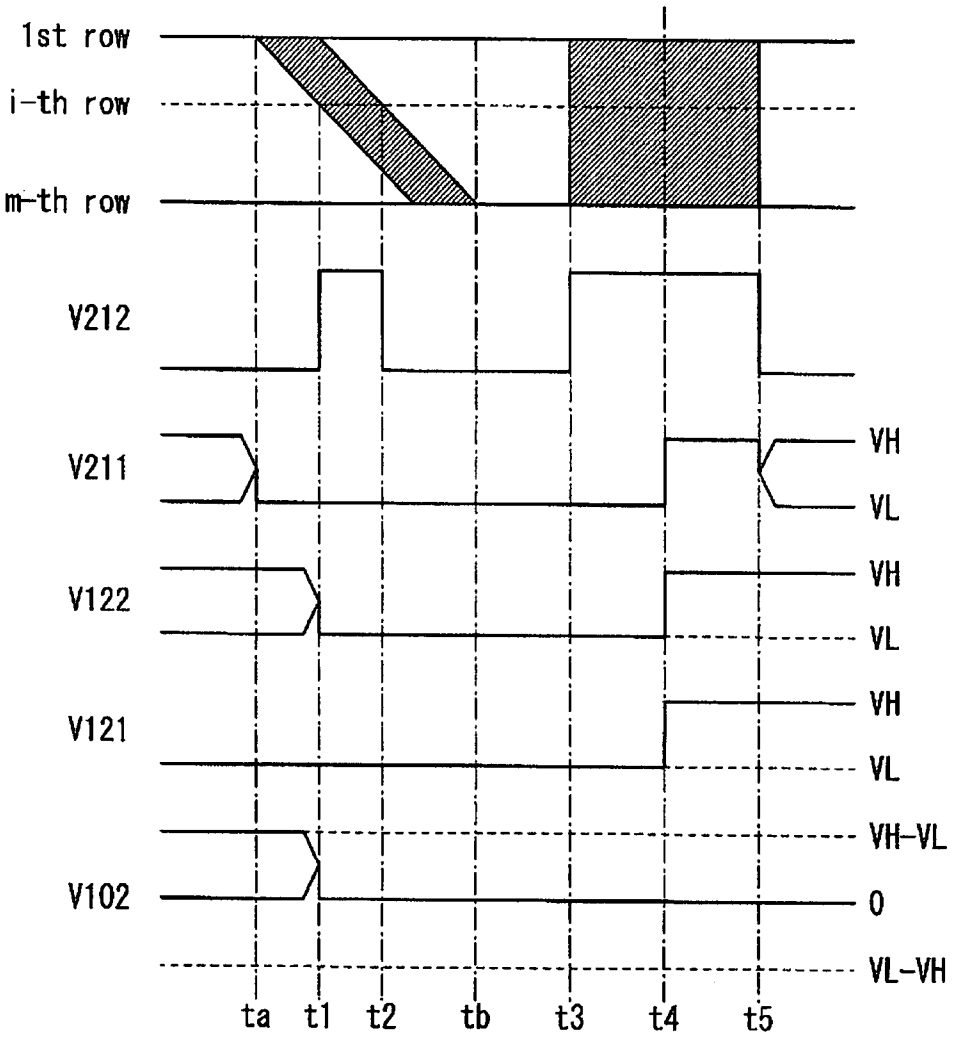
FIG. 15 is an example of a timing chart for explaining operation of a display device in Embodiment 2.

FIG. 15 is an example of a timing chart for the display device in this embodiment. The timing chart in FIG. 15 corresponds to the period TB in Embodiment 1. FIG. 15 shows the potential (V212) of the wiring 212 in the i-th row, the potential (V211) of the wiring 211, the potential (V122) of the electrode 122 of the pixel 204 in the i-th row, the potential (V121) of the electrode 121, and the voltage (V102) applied to the display element 102 in the pixel 204 in the i-th row.

First, the pixels 204 in the first row to the pixels 204 in the m-th row are sequentially selected (scanned) on a per column basis. The time at which selection of the pixels 204 in the first row starts is denoted by a time ta, and the time at which selection of the pixels 204 in the m-th row finishes is denoted by a time tb. In a period from the time ta to the time tb, a potential same as that of the electrode 121 is applied to the wiring 211. Here, the potential VL is applied to the electrode 121, so that the potential VL is applied to the wiring 211. Consequently, the potential VL is written into each pixel 204, and zero voltage is applied to the display element 102 in each pixel 204. Then, at a time t3, the pixels 204 in all the rows are concurrently selected. At this time, when the potential VL is applied to the electrode 121, the potential VL is also applied to the wiring 211. Thus, zero voltage continues to be applied to the display element 102 in each pixel 204. After that, at a time t4, the potential VH is applied to the electrode 121 and the potential VH is also applied to the wiring 211 at the same timing. Thus, zero voltage continues to be applied to the display element 102 in each pixel 204. Then, at a time t5, selection of the pixels 204 in all the rows finishes.

Here, attention is focused on the pixels 204 in the i-th row. The pixels 204 in the i-th row are selected between the time t1 and the time t2 and between the time t3 to the time t5. From the time t1 to the time t2, the pixels 204 in the i-th row are selected and the potential of the wiring 211 is written. At this time, the potential VL is applied to the wiring 211, so that the potential of the electrode 122 becomes equal to the potential VL. Moreover, the potential VL is applied to the electrode 121, so that zero voltage is applied to the display element 102. From the time t2 to the time t3, the pixels 204 in the i-th row are in a non-selection state. At this time, the potential of the electrode 122 remains equal to the potential VL, so that zero voltage continues to be applied to the display element 102. From the time t3 to the time t5, the pixels 204 in the i-th row are selected and the potential of the wiring 211 is written. The potential VL is applied to the wiring 211 until the time t4, so that the potential of the electrode 121 remains equal to the potential VL. Furthermore, the potential VL continues to be applied to the electrode 121, so that zero voltage continues to be applied to the display element 102. At the time t4, the potential VH is applied to the electrode 121. At the same time, the potential VH is also applied to the wiring 211, so that zero voltage continues to be applied to the display element 102.

As described above, the pixels 204 in the i-th row can operate in a manner similar to that of the pixels in Embodiment 1. That is, all the pixels 204 of the first to m-th rows can operate in a manner similar to that of the pixels in Embodiment 1.

Note that the pixels 204 of all rows can be concurrently selected at the same timing as the end of selection of the pixels 204 in the m-th rows.

Figure 16:
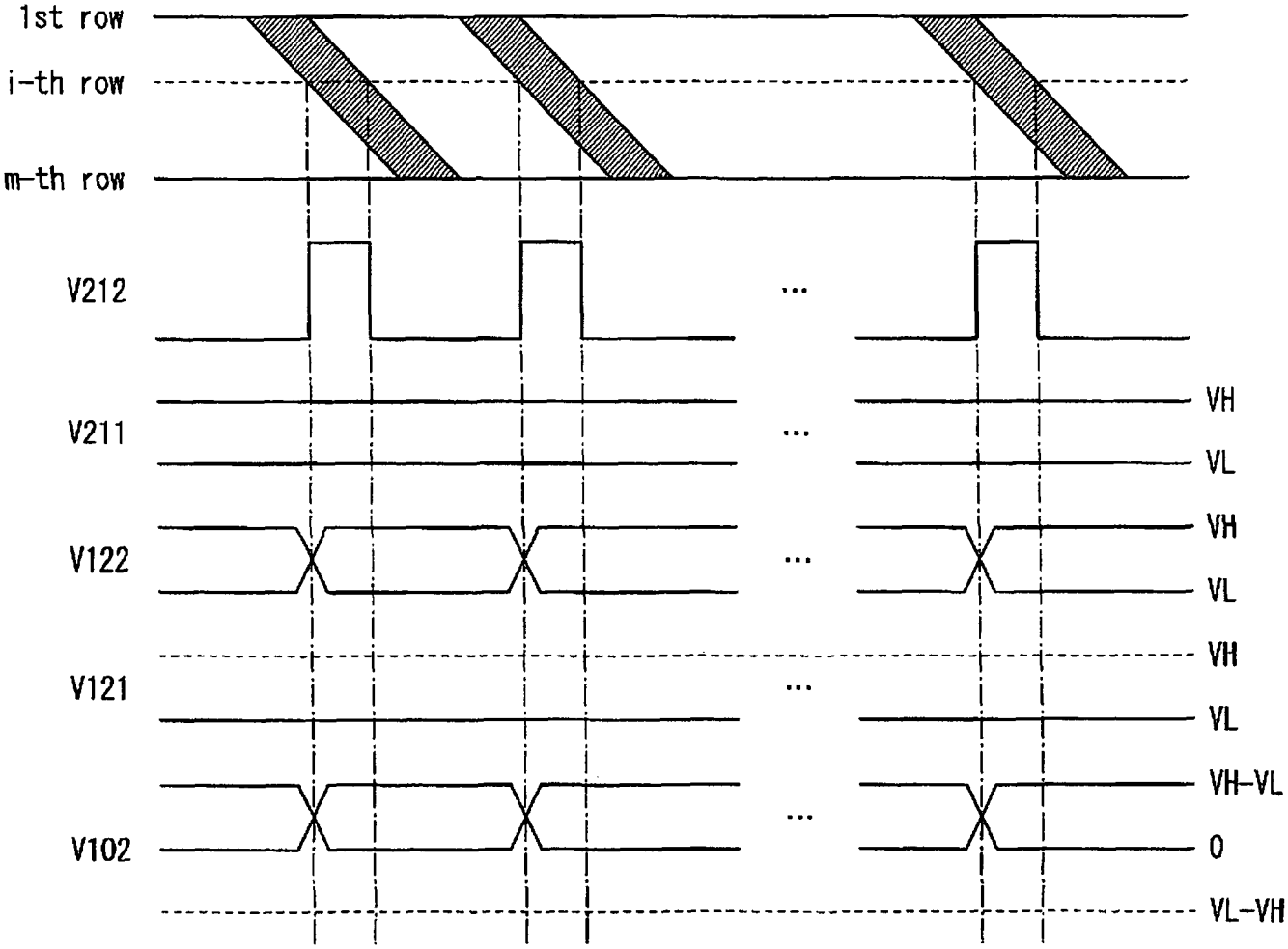
FIG. 16 is an example of a timing chart for explaining operation of a semiconductor device in Embodiment 2.

Next, FIG. 16 is an example of a timing chart for the display device in this embodiment. The timing chart in FIG. 16 corresponds to the period TA in Embodiment 1. FIG. 16 shows the potential of the wiring 212 in the i-th row, the potential of the wiring 211, the potential of the electrode 122 of the pixel 204 in the i-th row, the potential of the electrode 121, and the voltage applied to the display element 102 in the pixel 204.

First, the pixels 204 in the first row to the pixels 204 in the m-th row are sequentially selected (scanned) on a per column basis. At this time, one of the potential VL and the potential VH is applied to the electrode 121, and the potential VH and the potential VL are selectively applied to the wiring 211. In FIG. 16, the potential VL is applied to the electrode 121; thus, zero voltage and the voltage VH-VL are selectively applied to the display element 102 in each pixel 204. In the display device in this embodiment, such operation of applying voltage to the display element 102 in the pixel 204 is performed once or plural times.

Here, attention is focused on the pixels 204 in the i-th row. The pixels 204 in the i-th row are selected. At this time, the potential VH and the potential VL are selectively applied to the wiring 211. Thus, zero voltage and the voltage VH-VL are selectively applied to the display element 102 in each of the pixels 204 in the i-th row.

As described above, the pixels 204 in the i-th row can operate in a manner similar to that of the pixels in Embodiment 1. That is, all the pixels 204 of the first to m-th rows can operate in a manner similar to that of the pixels in Embodiment 1.

Note that a period after scanning starts until next scanning starts can be constant as illustrated in FIG. 16 or can vary.

(Embodiment 3)

In this embodiment, an example of a pixel different from the pixel in Embodiment 1 and an example of a method for driving the pixel will be described.

Figure 17B:
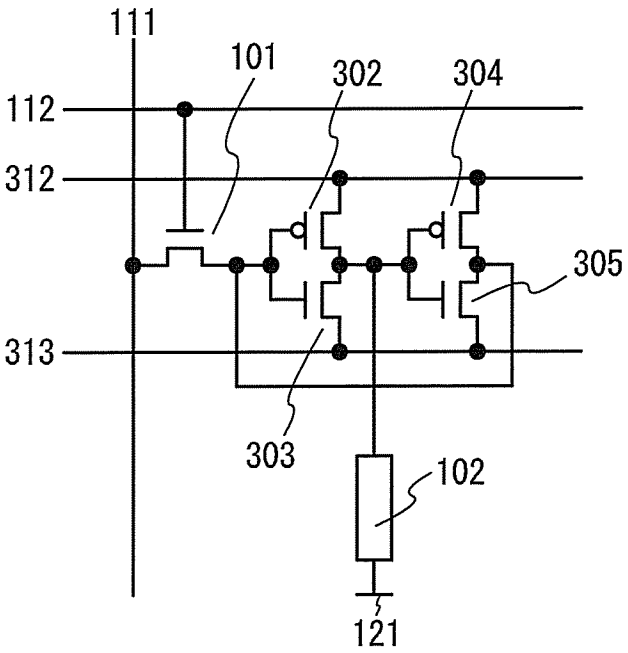
FIGS. 17A and 17B are examples of circuit diagrams of pixels in Embodiment 3.
Figure 17A:
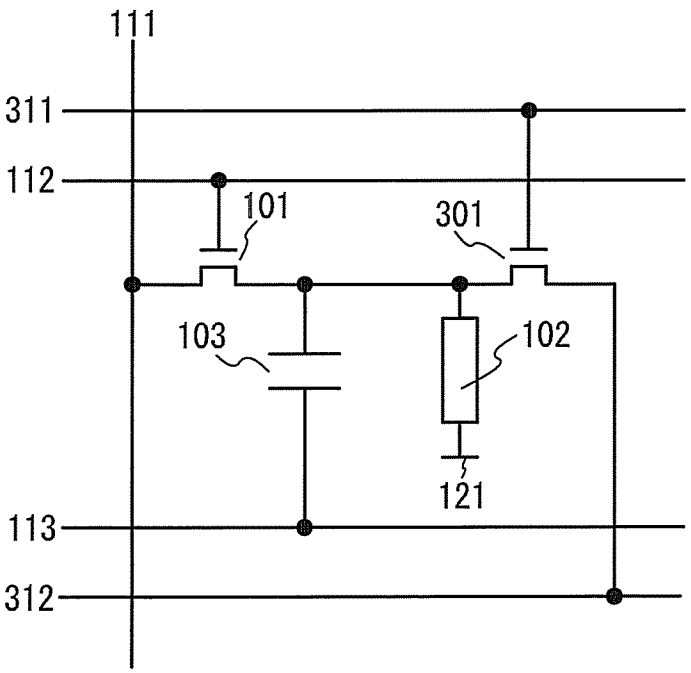

FIG. 17A illustrates an example of the case where a transistor 301 is additionally provided in the pixel illustrated in FIG. 1A. A first terminal of the transistor 301 is connected to a wiring 312. A second terminal of the transistor 301 is connected to one electrode of the display element 102. A gate of the transistor 301 is connected to a wiring 311. The transistor 301 has a function of controlling electrical continuity between the wiring 312 and one electrode of the display element 102. The wiring 312 is supplied with a potential same as that of the electrode 121. Thus, when the transistor 301 is turned on, zero voltage is applied to the display element 102. Consequently, the time during which the voltage is applied to the display element 102 can be shortened, so that the gray level of the display element 102 can be minutely controlled. Alternatively, the time for scanning the pixels can be extended as the time during which the voltage is applied to the display element 102 is shortened. In other words, the drive frequency can be lowered, leading to a reduction in power consumption.

In the case where the time after a pixel is selected until the pixel is selected again is weighted, the pixel preferably has the structure illustrated in FIG. 17A because the minimum length of a period for applying a voltage to the display element 102 can be shortened. Thus, the gray level of the display element 102 can be minutely controlled. Alternatively, the drive frequency can be lowered, so that power consumption can be reduced.

Note that the first terminal of the transistor 301 can be connected to a wiring other than the wiring 312 (e.g., to the wiring 113).

FIG. 17B illustrates an example of the case where an SRAM circuit is used instead of the capacitor 103 in the pixel illustrated in FIG. 1A. The SRAM circuit includes a transistor 302, a transistor 303, a transistor 304, and a transistor 305. The transistors 302 and 303 constitute an inverter circuit, and the transistors 304 and 305 constitute an inverter circuit. A first terminal of the transistor 302 is connected to the wiring 312. A first terminal of the transistor 303 is connected to a wiring 313. A second terminal of the transistor 303 is connected to a second terminal of the transistor 302. A gate of the transistor 303 is connected to a gate of the transistor 302. A first terminal of the transistor 304 is connected to the wiring 312. A second terminal of the transistor 304 is connected to the gate of the transistor 302. A gate of the transistor 304 is connected to the second terminal of the transistor 302. A first terminal of the transistor 305 is connected to the wiring 313. A second terminal of the transistor 305 is connected to the gate of the transistor 302. A gate of the transistor 305 is connected to the second terminal of the transistor 302. A second terminal of the transistor 101 is connected to the gate of the transistor 302. One electrode of the display element 102 is connected to the second terminal of the transistor 302.

The potential VH is applied to the wiring 312 and the potential VL is applied to the wiring 313; accordingly, the wirings 312 and 313 have a function of a power supply line.

(Embodiment 4)

In this embodiment, a layout diagram of a semiconductor device will be described. Specifically, a layout diagram of the pixel in Embodiment 1 will be described with reference to FIG. 18.

A transistor, a capacitor, a wiring, and the like include a conductive layer 401, a semiconductor layer 402, a conductive layer 403, a conductive layer 404, a contact hole 405, and/or the like. Note that an insulating layer, another conductive layer, another contact hole, and the like can be formed in addition to these layers.

The conductive layer 401 includes a portion having a function of a gate electrode of the transistor, an electrode of the capacitor, and/or the wiring. The semiconductor layer 402 includes a portion having a function of a channel region of the transistor, a source region of the transistor, and/or a drain region of the transistor. The conductive layer 403 includes a portion having a function of a source electrode of the transistor, a drain electrode of the transistor, an electrode of the capacitor, and/or the wiring. The conductive layer 404 includes a portion functioning as a pixel electrode. The contact hole 405 has a function of connecting the conductive layer 401 and the conductive layer 404 and/or a function of connecting the conductive layer 403 and the conductive layer 404.

The conductive layer 404 is placed so as to overlap with the wiring 111 and the wiring 112, resulting in a reduction in the gap between a pixel electrode (e.g., part of the conductive layer 404) of one pixel and a pixel electrode of a pixel adjacent to the pixel. The optical aperture ratio can be increased in such a manner, leading to improvement in display quality. The optical aperture ratio is the percentage of the area where the state of a display element can be controlled in one pixel, for example, the percentage of the area occupied by the pixel electrode in one pixel.

Note that the potential of the conductive layer 404 is likely to vary when the conductive layer 404 and the wiring 111 overlap with each other. Variation in potential of the conductive layer 404 can be suppressed by an increase in capacitance of the capacitor 103. Therefore, the area of the capacitor 103 accounts for preferably 30 to 90%, more preferably 40 to 80%, further preferably 50 to 70% of the area of a portion functioning as the pixel electrode in the conductive layer 404.

Note that the area of the capacitor 103 is the area where the conductive layer 401 having a function of one electrode of the capacitor 103 overlaps with the conductive layer 403 having a function of the other electrode of the capacitor 103.

Note that the conductive layer 404 can alternatively be placed so as to overlap with only one of the wiring 111 and the wiring 112.

The conductive layer 404 is preferably placed so as to overlap with the wiring 112 in the previous row because change in potential of the conductive layer 404 due to change in potential of the wiring 112 can be suppressed.

Figure 18:
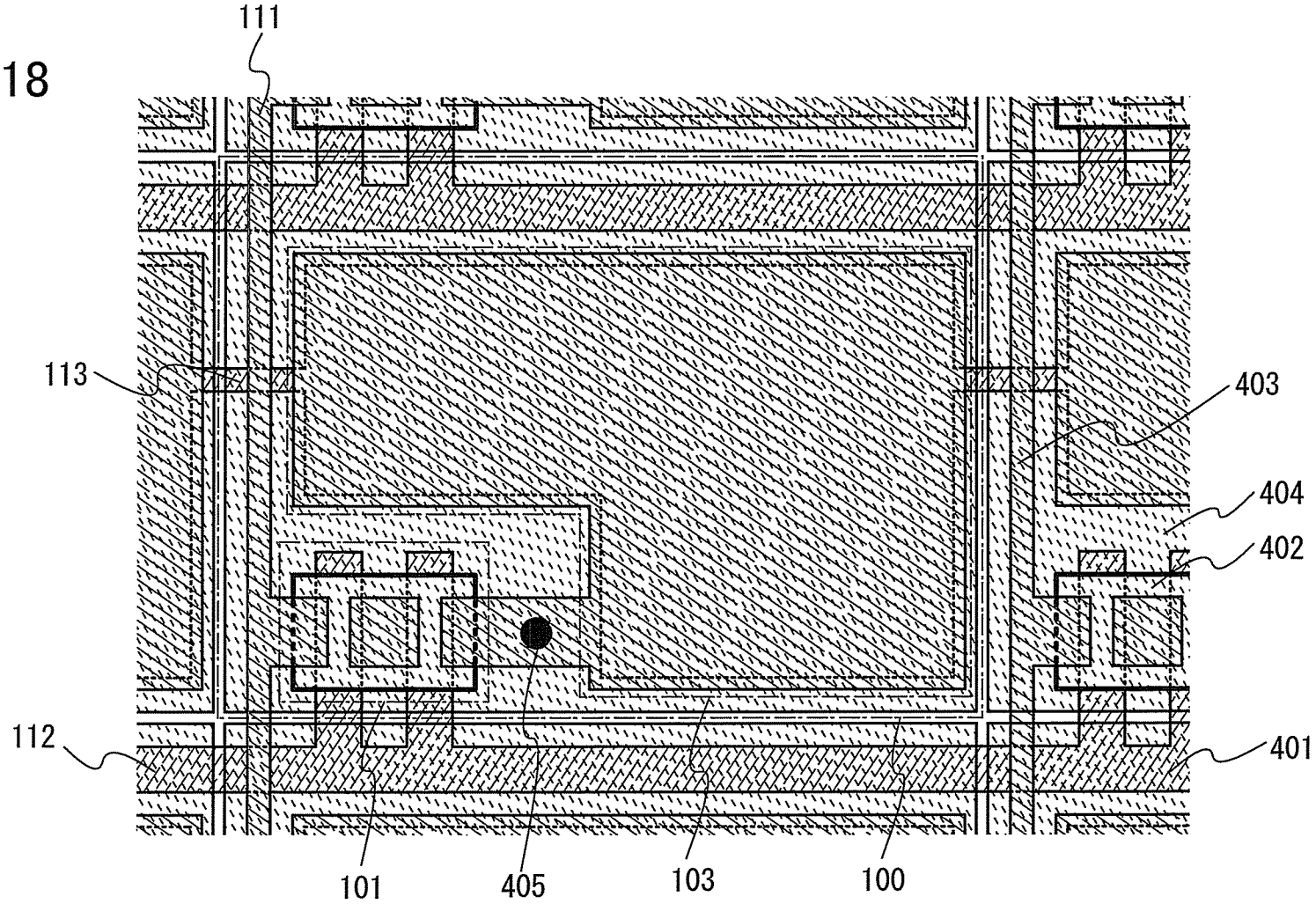
FIG. 18 is an example of a top view of a pixel in Embodiment 4.

As the transistor 101, a transistor with a multi-gate structure having two or more gate electrodes can be used. In FIG. 18, the transistor 101 has a multi-gate structure having two gate electrodes. With the multi-gate structure, a structure where a plurality of transistors are connected in series is provided because channel regions are connected in series. The off-state current of the transistor 101 can thus be reduced. Such a transistor is preferably used in combination with a display element with memory properties and high driving voltage.

(Embodiment 5)

In this embodiment, a structure of a semiconductor device will be described. Specifically, an example of a structure of a transistor will be described.

Figure 19:
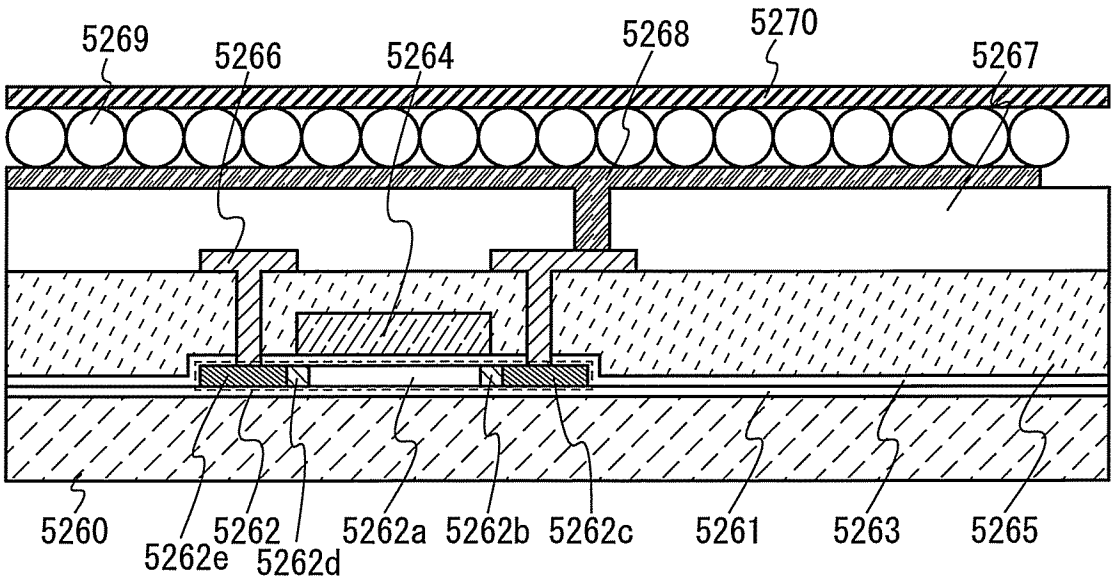
FIG. 19 is an example of a cross-sectional view of a semiconductor device in Embodiment 5.

FIG. 19 illustrates an example of a top-gate transistor and an example of a display element formed over the top-gate transistor. The transistor in FIG. 19 includes a substrate 5260; an insulating layer 5261; a semiconductor layer 5262 including a region 5262*a*, a region 5262*b*, a region 5262*c*, a region 5262*d*, and a region 5262*e*; an insulating layer 5263; a conductive layer 5264; an insulating layer 5265 having openings; and a conductive layer 5266. The insulating layer 5261 is formed over the substrate 5260. The semiconductor layer 5262 is formed over the insulating layer 5261. The insulating layer 5263 is formed so as to cover the semiconductor layer 5262. The conductive layer 5264 is formed over the semiconductor layer 5262 and the insulating layer 5263. The insulating layer 5265 is formed over the insulating layer 5263 and the conductive layer 5264. The conductive layer 5266 is formed over the insulating layer 5265 and in the openings formed in the insulating layer 5265. Thus, the top-gate transistor is formed.

Figure 23A:
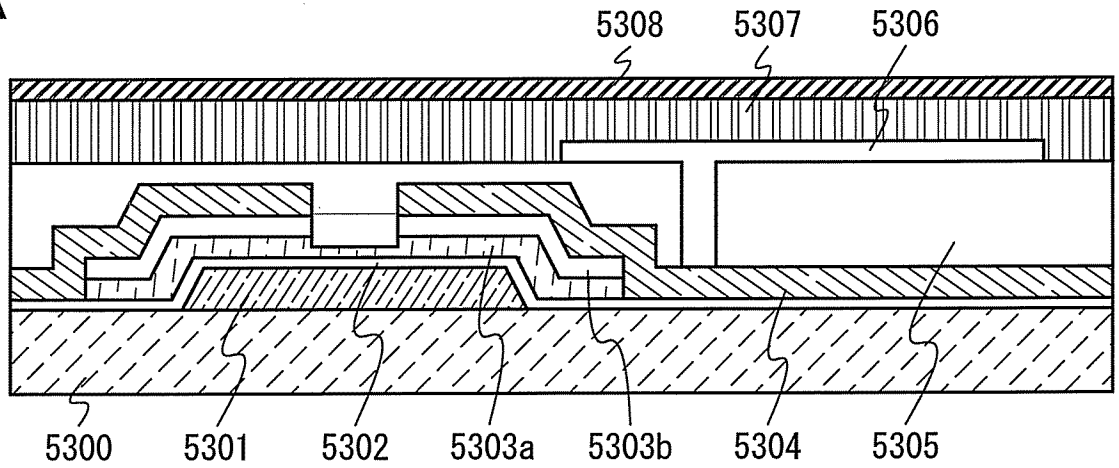
FIGS. 23A and 23B are examples of cross-sectional views of semiconductor devices in Embodiment 5.

FIG. 23A illustrates an example of a bottom-gate transistor and an example of a display element formed over the bottom-gate transistor. The transistor in FIG. 23A includes a substrate 5300, a conductive layer 5301, an insulating layer 5302, a semiconductor layer 5303*a*, a semiconductor layer 5303*b*, a conductive layer 5304, an insulating layer 5305 having an opening, and a conductive layer 5306. The conductive layer 5301 is formed over the substrate 5300. The insulating layer 5302 is formed so as to cover the conductive layer 5301. The semiconductor layer 5303*a* is formed over the conductive layer 5301 and the insulating layer 5302. The semiconductor layer 5303*b* is formed over the semiconductor layer 5303*a*. The conductive layer 5304 is formed over the semiconductor layer 5303*b* and the insulating layer 5302. The insulating layer 5305 is formed over the insulating layer 5302 and the conductive layer 5304. The conductive layer 5306 is formed over the insulating layer 5305 and in the opening formed in the insulating layer 5305. Thus, the bottom-gate transistor is formed.

Figure 23B:
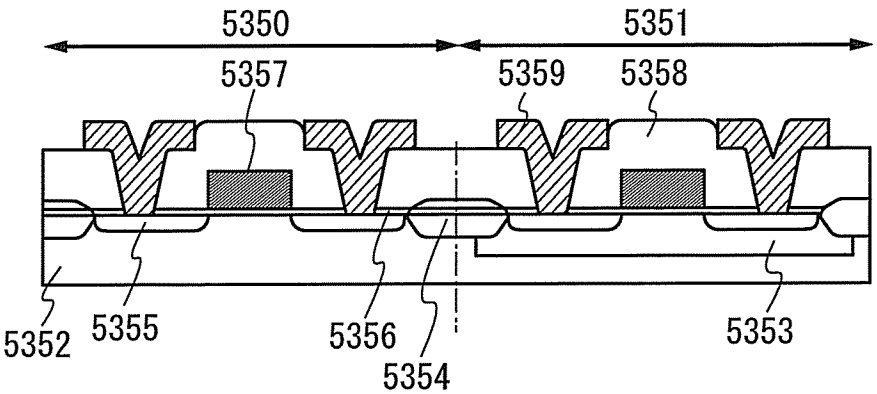

FIG. 23B illustrates an example of a transistor including a semiconductor substrate. The transistor in FIG. 23B includes a semiconductor substrate 5352 including a region 5353 and a region 5355, an insulating layer 5356, an insulating layer 5354, a conductive layer 5357, an insulating layer 5358 having openings, and a conductive layer 5359. The insulating layer 5354 is formed on the semiconductor substrate 5352. The insulating layer 5356 is formed over the semiconductor substrate 5352. The conductive layer 5357 is formed over the insulating layer 5356. The insulating layer 5358 is formed over the insulating layer 5354, the insulating layer 5356, and the conductive layer 5357. The conductive layer 5359 is formed over the insulating layer 5358 and in the openings formed in the insulating layer 5358. Thus, a transistor is formed in each of a region 5350 and a region 5351.

As illustrated in FIG. 19, an insulating layer 5267 having an opening, a conductive layer 5268, a microcapsule electrophoretic element 5269, and a conductive layer 5270 can be formed over any of the transistors illustrated in FIG. 19 and FIGS. 23A and 23B.

As illustrated in FIG. 23A, a liquid crystal layer 5307 and a conductive layer 5308 can be formed over any of the transistors illustrated in FIG. 19 and FIGS. 23A and 23B. The liquid crystal layer 5307 is placed over the insulating layer 5305 and the conductive layer 5306. The conductive layer 5308 is formed over the liquid crystal layer 5307.

Note that a variety of components can be formed in addition to the layers illustrated in FIG. 19 and FIGS. 23A and 23B. For example, an insulating layer that serves as an alignment film and/or an insulating layer that serves as a protrusion can be formed over the insulating layer 5305 and the conductive layer 5306. As another example, an insulating layer that serves as a protrusion, a color filter, and/or a black matrix can be formed over the conductive layer 5308. As another example, an insulating layer that serves as an alignment film can be formed below the conductive layer 5308.

The insulating layer 5261 has a function of a base film. The insulating layer 5354 serves as an element isolation layer (e.g., a field oxide film). Each of the insulating layer 5263, the insulating layer 5302, and the insulating layer 5356 serves as a gate insulating film. Each of the conductive layer 5264, the conductive layer 5301, and the conductive layer 5357 serves as a gate electrode. Each of the insulating layer 5265, the insulating layer 5267, the insulating layer 5305, and the insulating layer 5358 serves as an interlayer film or a planarization film. Each of the conductive layer 5266, the conductive layer 5304, and the conductive layer 5359 serves as a wiring, an electrode of a transistor, an electrode of a capacitor, or the like. Each of the conductive layer 5268 and the conductive layer 5306 serves as a pixel electrode, a reflective electrode, or the like. The insulating layer 5267 serves as a partition. Each of the conductive layer 5270 and the conductive layer 5308 serves as a counter electrode, a common electrode, or the like.

Note that each of the region 5262*c* and the region 5262*e* is a region to which an impurity is added, and serves as a source region or a drain region. Each of the region 5262*b* and the region 5262*d* is a region to which an impurity is added at a lower concentration than the region 5262*c* or the region 5262*e*, and serves as an LDD (lightly doped drain) region. The region 5262*a* is a region to which an impurity is not added, and serves as a channel region. However, this embodiment is not limited to this. For example, an impurity can be added to the region 5262*a*; thus, it is possible to improve the characteristics of the transistor and control the threshold voltage. Note that the concentration of the impurity added to the region 5262*a* is preferably lower than that of the impurity added to the region 5262*b*, the region 5262*c*, the region 5262*d*, or the region 5262*e*. As another example, the region 5262*c* or the region 5262*e* can be omitted. Alternatively, only an n-channel transistor can have the region 5262*c* or the region 5262*e*.

The semiconductor layer 5303*b* is a semiconductor layer to which phosphorus or the like is added as an impurity element and has n-type conductivity. Note that in the case where an oxide semiconductor or a compound semiconductor is used for the semiconductor layer 5303*a*, the semiconductor layer 5303*b* can be omitted.

An example of the semiconductor substrate 5352 is a single crystal silicon substrate having n-type or p-type conductivity. The region 5353 is formed by addition of an impurity to the semiconductor substrate 5352 and serves as a well. For example, in the case where the semiconductor substrate 5352 has p-type conductivity, the region 5353 has n-type conductivity. On the other hand, in the case where the semiconductor substrate 5352 has n-type conductivity, the region 5353 has p-type conductivity. The region 5355 is formed by addition of an impurity to the semiconductor substrate 5352 and serves as a source region or a drain region. Note that an LDD region can be formed in the semiconductor substrate 5352.

Next, examples of materials, examples of structures, and features of these layers will be described.

Examples of the substrates (e.g., the substrate 5260 and the substrate 5300) are a semiconductor substrate (e.g., a single crystal substrate and a silicon substrate), an SOI substrate, a glass substrate, a quartz substrate, a plastic substrate, a flexible substrate, and a bonding film. Examples of a glass substrate are a barium borosilicate glass substrate, an aluminoborosilicate glass substrate, and a soda-lime glass substrate. For a flexible substrate, a flexible synthetic resin such as plastics typified by polyethylene terephthalate (PET), polyethylene naphthalate (PEN), and polyether sulfone (PES), or acrylic can be used, for example.

The insulating layers (e.g., the insulating layer 5261, the insulating layer 5263, the insulating layer 5265, the insulating layer 5267, the insulating layer 5302, the insulating layer 5305, the insulating layer 5356, and the insulating layer 5358) each have a single-layer structure or a stacked structure of a film containing oxygen or nitrogen (e.g., silicon oxide ($SiO_x$) or silicon nitride ($SiN_x$)), an organic material (e.g., a siloxane resin, epoxy, or acrylic), or the like. Note that one example of this embodiment is not limited to these structures.

Examples of the material for the semiconductor layers (e.g., the semiconductor layer 5262, the semiconductor layer 5303*a*, and the semiconductor layer 5303*b*) are a non-single-crystal semiconductor (e.g., amorphous silicon, polycrystalline silicon, and microcrystalline silicon), a single crystal semiconductor, a compound semiconductor (e.g., SiGe and GaAs), an oxide semiconductor (e.g., ZnO, InGaZnO, IZO (indium zinc oxide), ITO (indium tin oxide), SnO, TiO, and AlZnSnO (AZTO)), an organic semiconductor, and a carbon nanotube.

Examples of the conductive layers (e.g., the conductive layer 5264, the conductive layer 5266, the conductive layer 5268, the conductive layer 5270, the conductive layer 5301, the conductive layer 5304, the conductive layer 5306, the conductive layer 5308, the conductive layer 5357, and the conductive layer 5359) are a single-layer film and a multilayer film. Examples of the material for the single-layer film are aluminum (Al), tantalum (Ta), titanium (Ti), molybdenum (Mo), and tungsten (W) and a compound containing one or more of these elements.

(Embodiment 6)

In this embodiment, an example of a process for manufacturing a semiconductor device will be described. Specifically, examples of structures of a transistor and a capacitor will be described. In particular, a manufacturing process in which an oxide semiconductor is used for a semiconductor layer will be described. For an oxide semiconductor layer, a layer represented by $InMO_3(ZnO)_m$ ($m>0$) can be used. Note that M represents one or more of metal elements selected from Ga, Fe, Ni, Mn, and Co. For example, M may denote Ga or may contain the above metal element in addition to Ga (e.g., Ga and Ni or Ga and Fe). Note that an oxide semiconductor may contain a transition metal element such as Fe or Ni or oxide of the transition metal element as an impurity element in addition to the metal element contained as M.

Such a thin film can be referred to as an In—Ga—Zn—O-based non-single-crystal film. In addition, ZnO can be used as an oxide semiconductor.

The oxide semiconductor layer includes at least one element selected from In, Ga, Sn, and Zn. For example, any of the following oxide semiconductors can be used: an oxide of four metal elements such as an In—Sn—Ga—Zn—O-based oxide semiconductor; an oxide of three metal elements such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, or a Sn—Al—Zn—O-based oxide semiconductor; an oxide of two metal elements such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, an In—Mg—O-based oxide semiconductor, or an In—Ga—O-based oxide semiconductor; an oxide of one metal element such as an In—O-based oxide semiconductor, a Sn—O-based oxide semiconductor, or a Zn—O-based oxide semiconductor. In addition, any of the above oxide semiconductors may contain an element other than In, Ga, Sn, and Zn, for example, $SiO_2$.

For example, an In—Ga—Zn—O-based oxide semiconductor refers to an oxide semiconductor containing indium (In), gallium (Ga), and zinc (Zn), and there is no limitation on the composition ratio thereof.

For the oxide semiconductor layer, a thin film expressed by a chemical formula of $InMO_3(ZnO)_m$ (m>0) can be used. Here, M represents one or more metal elements selected from Zn, Ga, Al, Mn, and Co. For example, M can be Ga, Ga and Al, Ga and Mn, or Ga and Co.

In the case where an In—Zn—O-based material is used as the oxide semiconductor, a target used has a composition ratio of In:Zn=50:1 to 1:2 in an atomic ratio ($In_2O_3$:ZnO=25:1 to 1:4 in a molar ratio), preferably In:Zn=20:1 to 1:1 in an atomic ratio ($In_2O_3$:ZnO=10:1 to 1:2 in a molar ratio), further preferably In:Zn=15:1 to 1.5:1 ($In_2O_3$:ZnO=15:2 to 3:4 in a molar ratio). For example, when a target used for forming an In—Zn—O-based oxide semiconductor has a composition ratio of In:Zn:O=X:Y:Z in an atomic ratio, the relation of Z>(1.5X+Y) is satisfied.

Figure 20A:
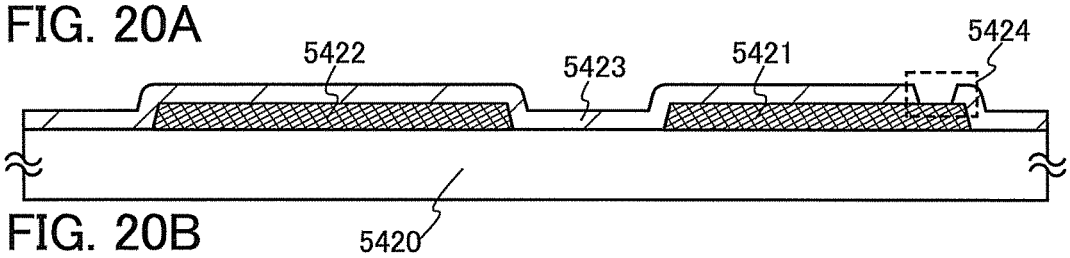
FIGS. 20A to 20E each illustrate an example of a step for manufacturing a semiconductor device in Embodiment 6.
Figure 20B:
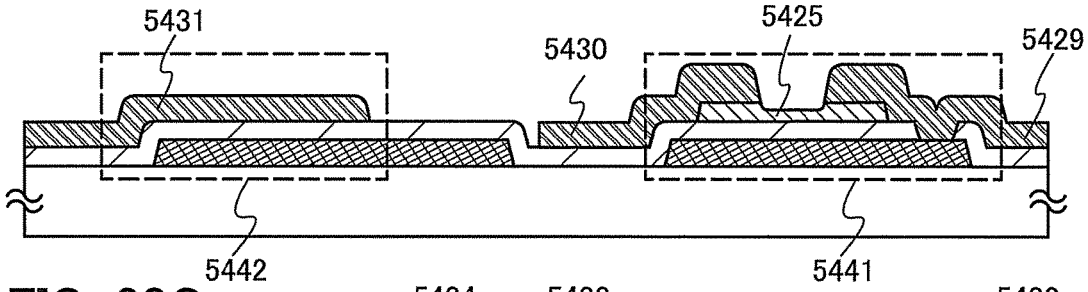
Figure 20C:
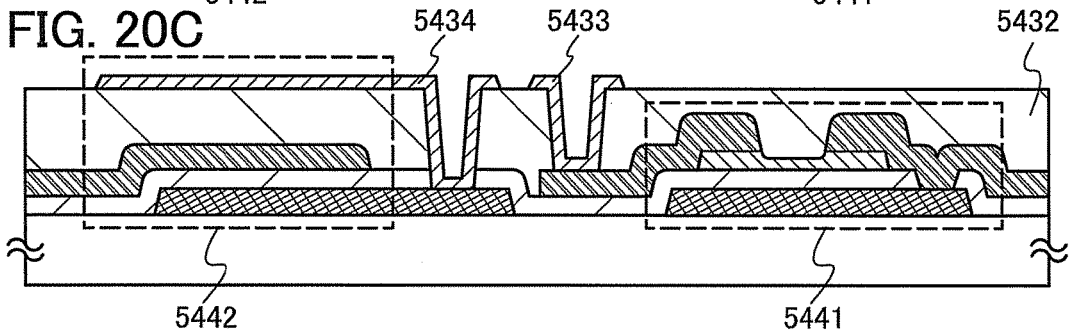

An example of a process for manufacturing a transistor and a capacitor will be described with reference to FIGS. 20A to 20C. FIGS. 20A to 20C illustrate an example of a process for manufacturing a transistor 5441 and a capacitor 5442. The transistor 5441 is an example of an inverted staggered transistor, in which a wiring is provided over an oxide semiconductor layer with a source electrode or a drain electrode placed therebetween.

First, a first conductive layer is formed over the entire surface of a substrate 5420 by sputtering. Next, the first conductive layer is selectively etched by using a resist mask formed through a photolithography process using a first photomask, so that a conductive layer 5421 and a conductive layer 5422 are formed. The conductive layer 5421 can function as a gate electrode. The conductive layer 5422 can function as one electrode of the capacitor. Note that this embodiment is not limited thereto, and each of the conductive layers 5421 and 5422 can include a portion functioning as a wiring, a gate electrode, or an electrode of the capacitor. Then, the resist mask is removed.

Next, an insulating layer 5423 is formed over the entire surface by plasma CVD or sputtering. The insulating layer 5423 can function as a gate insulating layer and is formed so as to cover the conductive layers 5421 and 5422. Note that the thickness of the insulating layer 5423 is 50 nm to 250 nm.

In the case where a silicon oxide layer is used as the insulating layer 5423, the silicon oxide layer can be formed by CVD using an organosilane gas. As the organosilane gas, a silicon-containing compound such as tetraethyl orthosilicate (TEOS) (chemical formula: $Si(OC_2H_5)_4$), tetramethylsilane (TMS) (chemical formula: $Si(CH_3)_4$), or tetramethylcyclotetrasiloxane (TMCTS) can be used.

Next, the insulating layer 5423 is selectively etched by using a resist mask formed through a photolithography process using a second photomask, so that a contact hole 5424 that reaches the conductive layer 5421 is formed. Then, the resist mask is removed. Note that this embodiment is not limited thereto, and the contact hole 5424 can be omitted. Alternatively, the contact hole 5424 can be formed after an oxide semiconductor layer is formed. A cross-sectional view of the steps so far corresponds to FIG. 20A.

Next, an oxide semiconductor layer is formed over the entire surface by sputtering. Note that this embodiment is not limited to this; an oxide semiconductor layer can be formed by sputtering and a buffer layer (e.g., an $n^+$ layer) can be formed thereover. The thickness of the oxide semiconductor layer is 5 nm to 200 nm.

Then, the oxide semiconductor layer is selectively etched using a third photomask. After that, the resist mask is removed.

Next, a second conductive layer is formed over the entire surface by sputtering. Then, the second conductive layer is selectively etched by using a resist mask formed through a photolithography process using a fourth photomask; thus, a conductive layer 5429, a conductive layer 5430, and a conductive layer 5431 are formed. The conductive layer 5429 is connected to the conductive layer 5421 through the contact hole 5424. Each of the conductive layers 5429 and 5430 can function as the source electrode or the drain electrode. The conductive layer 5431 can function as the other electrode of the capacitor. Note that this embodiment is not limited thereto, and each of the conductive layers 5429, 5430, and 5431 can include a portion functioning as a wiring, the source or drain electrode, or the electrode of the capacitor.

Note that if heat treatment (e.g., at 200° C. to 600° C.) is performed in a subsequent step, the second conductive layer preferably has heat resistance high enough to withstand the heat treatment. Thus, for the second conductive layer, Al and a heat-resistant conductive material (e.g., an element such as Ti, Ta, W, Mo, Cr, Nd, Sc, Zr, or Ce; an alloy containing any of these elements in combination; or nitride containing any of these elements) are preferably used in combination. Note that this embodiment is not limited thereto; by employing a stacked structure, the second conductive layer can have heat resistance. For example, it is possible to provide a layer of a heat-resistant conductive material such as Ti or Mo above and below an Al layer.

Part of the oxide semiconductor layer is also etched at the time of etching the second conductive layer, so that an oxide semiconductor layer 5425 is formed. By this etching, part of the oxide semiconductor layer 5425, which overlaps with the conductive layer 5421, and part of the oxide semiconductor layer 5425, over which the second conductive layer is not formed, are etched to be thinned in many cases. Note that this embodiment is not limited thereto, and it is possible not to etch the oxide semiconductor layer. Note that in the case where the buffer layer (e.g., the $n^+$ layer) is formed over the oxide semiconductor layer, the oxide semiconductor layer is often etched. Then, the resist mask is removed. The transistor 5441 and the capacitor 5442 are completed when this etching is finished. A cross-sectional view of the steps so far corresponds to FIG. 20B.

Next, heat treatment is performed at 200° C. to 600° C. in an air atmosphere or a nitrogen atmosphere. Through this heat treatment, rearrangement at the atomic level occurs in the In—Ga—Zn—O-based non-single-crystal layer. In this manner, strain that inhibits carrier movement is released through heat treatment (including light annealing). Note that there is no particular limitation on the timing at which the heat treatment is performed, and the heat treatment can be performed at any time after the oxide semiconductor layer is formed.

Then, an insulating layer 5432 is formed over the entire surface. The insulating layer 5432 can have a single-layer structure or a stacked structure. For example, when an organic insulating layer is used as the insulating layer 5432, the organic insulating layer is formed in the following manner: a composition which is a material for the organic insulating layer is applied and heat treatment is performed at 200° C. to 600° C. in an air atmosphere or a nitrogen atmosphere. By thus forming the organic insulating layer that is in contact with the oxide semiconductor layer, a transistor whose electric characteristics are highly reliable can be manufactured. Note that when the organic insulating layer is used as the insulating layer 5432, a silicon nitride film or a silicon oxide film can be provided below the organic insulating layer.

FIG. 20C illustrates an example in which the insulating layer 5432 is formed using a non-photosensitive resin; an end portion of the insulating layer 5432 is angular in the cross section of a region where the contact hole is formed. On the other hand, when the insulating layer 5432 is formed using a photosensitive resin, the end portion of the insulating layer 5432 can be curved in the cross section of the region where the contact hole is formed. Thus, the coverage of the insulating layer 5432 with a third conductive layer or a pixel electrode which is formed later is increased.

Note that instead of application of the composition, any of the following methods or tools can be used depending on the material of the insulating layer 5432: dip coating, spray coating, an ink-jet method, a printing method, a doctor knife, a roll coater, a curtain coater, and a knife coater.

Note that without performing the heat treatment after the oxide semiconductor layer is formed, the heat treatment for the composition, which is the material for the organic insulating layer, can also serve to heat the oxide semiconductor layer.

The insulating layer 5432 can be formed to a thickness of 200 nm to 5 μm, preferably 300 nm to 1 μm.

Then, the third conductive layer is formed over the entire surface. Next, the third conductive layer is selectively etched by using a resist mask formed through a photolithography process using a fifth photomask, so that a conductive layer 5433 and a conductive layer 5434 are formed. A cross-sectional view of the steps so far corresponds to FIG. 20C. Each of the conductive layers 5433 and 5434 can serve as a wiring, a pixel electrode, a reflective electrode, a light-transmitting electrode, or the electrode of the capacitor. In particular, the conductive layer 5434 can function as the electrode of the capacitor 5442 because it is connected to the conductive layer 5422. Note that this embodiment is not limited thereto, and the conductive layers 5433 and 5434 can have a function of connecting the first conductive layer and the second conductive layer. For example, when the conductive layer 5433 and the conductive layer 5434 are connected to each other, the conductive layer 5422 and the conductive layer 5430 can be connected to each other through the third conductive layer (the conductive layers 5433 and 5434).

Since the capacitor 5442 has a structure where the conductive layer 5431 is sandwiched between the conductive layers 5422 and 5434, the capacitance of the capacitor 5442 can be increased. Note that this embodiment is not limited to this structure, and one of the conductive layers 5422 and 5434 can be omitted.

Note that after the resist mask is removed by wet etching, it is possible to perform heat treatment at 200° C. to 600° C. in an air atmosphere or a nitrogen atmosphere.

Through the above steps, the transistor 5441 and the capacitor 5442 can be manufactured.

Figure 20D:
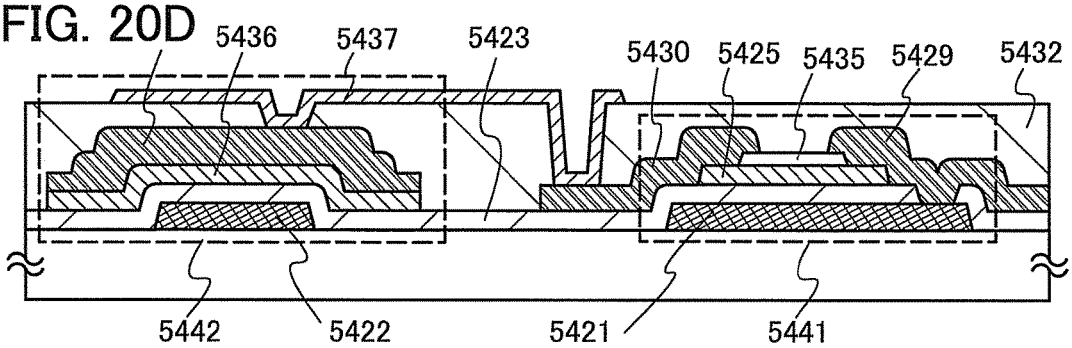

As illustrated in FIG. 20D, an insulating layer 5435 can be formed over the oxide semiconductor layer 5425. The insulating layer 5435 has a function of preventing the oxide semiconductor layer from being etched when the second conductive layer is patterned, and functions as a channel stop film. Thus, the thickness of the oxide semiconductor layer can be reduced, resulting in achieving reduction in driving voltage, reduction in off-state current, increase in the on/off ratio, improvement in subthreshold swing (S value), or the like of the transistor. The insulating layer 5435 can be formed in such a manner that an oxide semiconductor layer and an insulating layer are successively formed over the entire surface, and then, the insulating layer is selectively patterned using a resist mask formed through a photolithography process using a photomask. After that, the second conductive layer is formed over the entire surface, and the oxide semiconductor layer is patterned at the same time as the second conductive layer. That is, the oxide semiconductor layer and the second conductive layer can be patterned using the same mask (reticle). In that case, the oxide semiconductor layer is placed below the second conductive layer. In such a mariner, the insulating layer 5435 can be formed without increase in the number of steps. The oxide semiconductor layer is often formed below the second conductive layer in such a manufacturing process. However, this embodiment is not limited thereto. The insulating layer 5435 can be formed in the following manner: an oxide semiconductor layer is patterned, and then an insulating layer is formed over the entire surface and is patterned.

In FIG. 20D, the capacitor 5442 has a structure where the insulating layer 5423 and an oxide semiconductor layer 5436 are sandwiched between the conductive layers 5422 and 5431. Note that the oxide semiconductor layer 5436 can be omitted. The conductive layers 5430 and 5431 are connected to each other through a conductive layer 5437 that is formed by patterning of the third conductive layer. Such a structure can be used, for example, for a pixel of a liquid crystal display device. For example, the transistor 5441 can function as a switching transistor, and the capacitor 5442 can function as a storage capacitor. Moreover, each of the conductive layers 5421, 5422, 5429, and 5437 can function as a gate line, a capacitor line, a source line, and a pixel electrode, respectively. However, this embodiment is not limited thereto. In addition, as in FIG. 20D, the conductive layer 5430 and the conductive layer 5431 can be connected to each other through the third conductive layer in FIG. 20C.

Figure 20E:
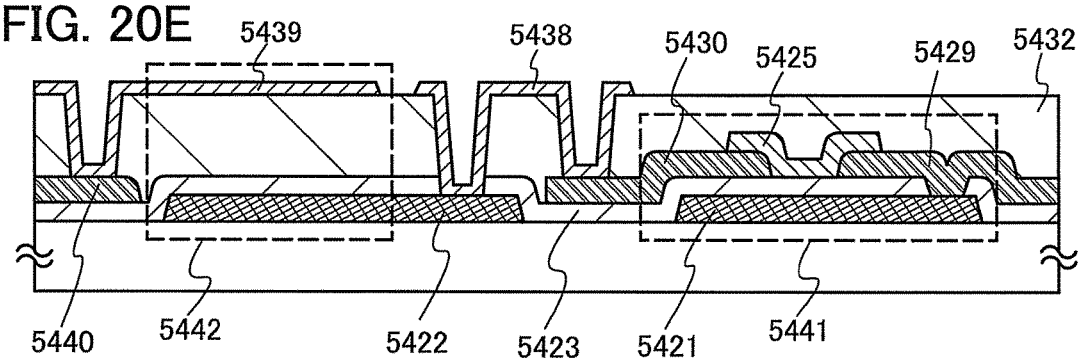

As illustrated in FIG. 20E, the oxide semiconductor layer 5425 can be formed after the second conductive layer is patterned. In that case, the oxide semiconductor layer is not yet formed when the second conductive layer is patterned; therefore, etching of the oxide semiconductor layer does not occur. Thus, the thickness of the oxide semiconductor layer can be reduced, so that reduction in driving voltage, reduction in off-state current, increase in the on/off ratio of drain current, improvement in subthreshold swing (S value), or the like of the transistor can be achieved. Note that the oxide semiconductor layer 5425 can be formed in such a manner that after the second conductive layer is patterned, an oxide semiconductor layer is formed over the entire surface and selectively patterned using a resist mask formed through a photolithography process using a photomask.

In FIG. 20E, the capacitor has a structure where the insulating layers 5423 and 5432 are sandwiched between the conductive layer 5422 and a conductive layer 5439 that is formed by patterning of the third conductive layer. The conductive layers 5422 and 5430 are connected to each other through a conductive layer 5438 that is formed by patterning of the third conductive layer. Further, the conductive layer 5439 is connected to a conductive layer 5440 that is formed by patterning of the second conductive layer. In addition, in FIGS. 20C and 20D, the conductive layers 5430 and 5422 can be connected to each other through the conductive layer 5438 as in FIG. 20E.

The thickness of the oxide semiconductor layer is preferably 20 nm or less, more preferably 10 nm or less, and further preferably 6 nm or less.

The thickness of the oxide semiconductor layer is preferably small in order to achieve reduction in operation voltage, reduction in off-state current, increase in the on/off ratio, improvement in S value, or the like of the transistor. For example, the thickness of the oxide semiconductor layer is preferably smaller than that of the insulating layer 5423. Specifically, the thickness of the oxide semiconductor layer is preferably ½ or less, more preferably ⅕ or less, further preferably 1/10 or less that of the insulating layer 5423. Note that this embodiment is not limited thereto, and the thickness of the oxide semiconductor layer can be larger than that of the insulating layer 5423 in order to improve the reliability. The thickness of the oxide semiconductor layer is preferably larger particularly in the case where the oxide semiconductor layer is etched as in FIG. 20C; therefore, it is possible to make the thickness of the oxide semiconductor layer larger than that of the insulating layer 5423.

Note that the thickness of the insulating layer 5423 is preferably larger than that of the first conductive layer in order to increase the withstand voltage of the transistor. Specifically, the thickness of the insulating layer 5423 is preferably 5/4 or more, further preferably 4/3 or more that of the first conductive layer. Note that this embodiment is not limited thereto, and the thickness of the insulating layer 5423 can be smaller than that of the first conductive layer in order to increase the mobility of the transistor.

Note that the oxide semiconductor is purified so as to contain impurities other than the main components as little as possible, so that the transistor can operate in a favorable manner. For example, the off-state current at room temperature can be reduced to approximately $1\times10^{-19}$ A (100 zA (zeptoamperes)) to $1\times10^{-20}$ A (10 zA).

Note that for the substrate, the insulating layer, the conductive layer, and the semiconductor layer in this embodiment, the materials described in the other embodiments or materials which are similar to those described in this specification can be used.

(Embodiment 7)

In this embodiment, examples of electronic devices will be described.

FIGS. 21A to 21H and FIGS. 22A to 22D each illustrate an electronic device. These electronic devices can include a housing 5000, a display portion 5001, a speaker 5003, an LED lamp 5004, operation keys 5005 (including a power switch or an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 5008, and the like.

Figure 21A:
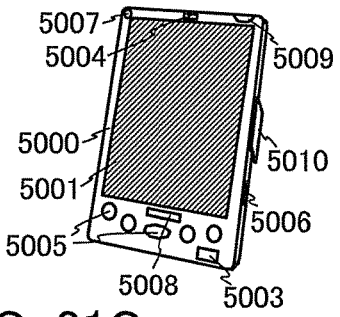
FIGS. 21A to 21H each illustrate an example of an electronic device in Embodiment 7.
Figure 21B:
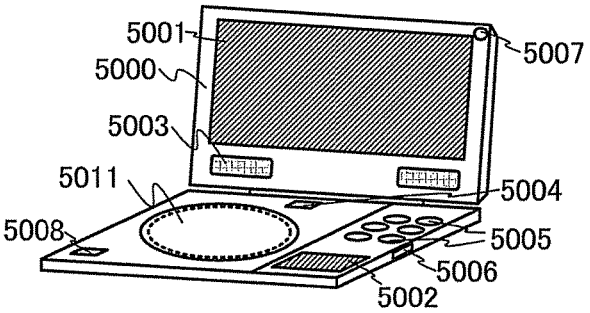
Figure 21C:
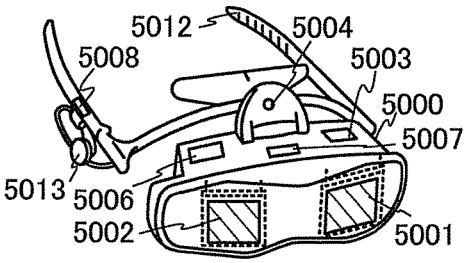
Figure 21D:
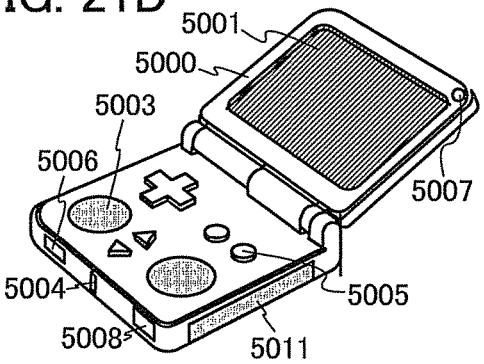
Figure 21E:
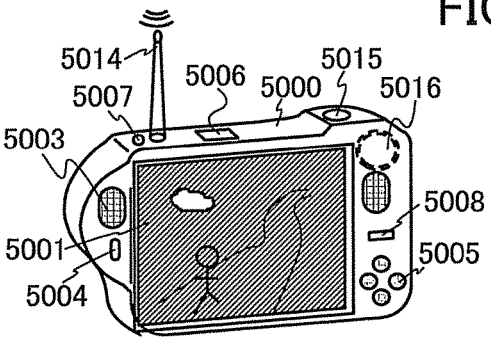
Figure 21F:
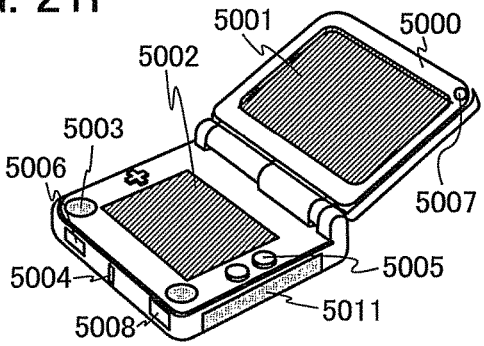
Figure 21G:
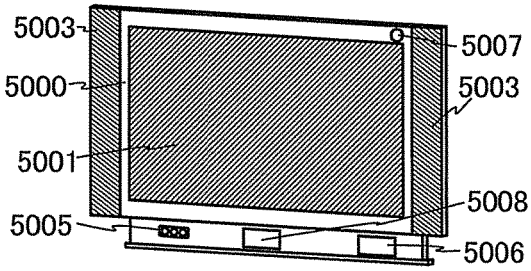
Figure 21H:
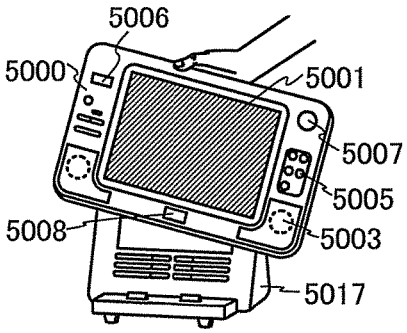
Figure 22A:
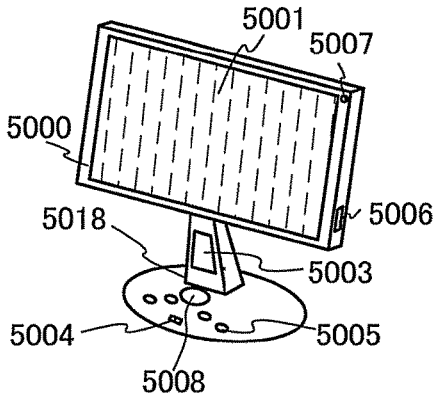
FIGS. 22A to 22H each illustrate an example of an electronic device in Embodiment 7.
Figure 22B:
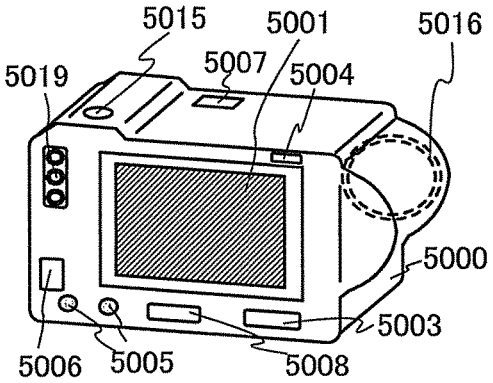
Figure 22C:
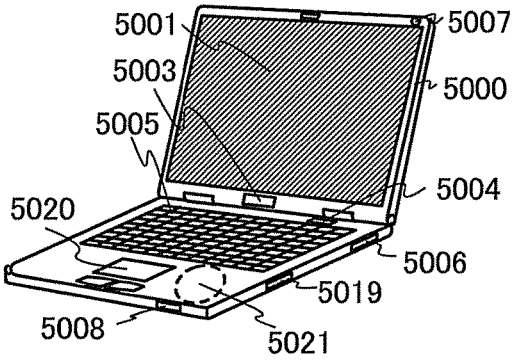
Figure 22D:
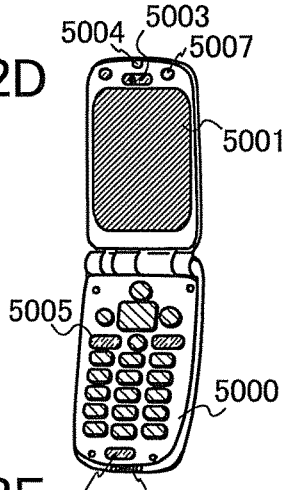

FIG. 21A illustrates a mobile computer that can include a switch 5009, an infrared port 5010, and the like in addition to the above components. FIG. 21B illustrates a portable image reproducing device (e.g., a DVD reproducing device) provided with a memory medium, and the image reproducing device can include a second display portion 5002, a memory medium reading portion 5011, and the like in addition to the above components. FIG. 21C illustrates a goggle-type display that can include a second display portion 5002, a support portion 5012, an earphone 5013, and the like in addition to the above components. FIG. 21D illustrates a portable game machine that can include a memory medium reading portion 5011 and the like in addition to the above components. FIG. 21E illustrates a digital camera having a television reception function, and the digital camera can include an antenna 5014, a shutter button 5015, an image receiving portion 5016, and the like in addition to the above objects. FIG. 21F illustrates a portable game machine that can include a second display portion 5002, a memory medium reading portion 5011, and the like in addition to the above components. FIG. 21G illustrates a television set that can include a tuner, an image processing portion, and the like in addition to the above components. FIG. 21H illustrates a portable television receiver that can include a charger 5017 capable of transmitting and receiving signals and the like in addition to the above components. FIG. 22A illustrates a display that can include a support base 5018 and the like in addition to the above components. FIG. 22B illustrates a camera that can include an external connection port 5019, a shutter button 5015, an image receiving portion 5016, and the like in addition to the above components. FIG. 22C illustrates a computer that can include a pointing device 5020, an external connection port 5019, a reader/writer 5021, and the like in addition to the above components. FIG. 22D illustrates a mobile phone that can include a transmitter, a receiver, a tuner of one-segment partial reception service for mobile phones and mobile terminals ("1seg"), and the like in addition to the above components.

The electronic devices illustrated in FIGS. 21A to 21H and FIGS. 22A to 22D can have a variety of functions, for example, a function of displaying a variety of information (e.g., a still image, a moving image, and a text image) on a display portion; a touch panel function; a function of displaying a calendar, date, time, and the like; a function of controlling process with a variety of software (programs); a wireless communication function; a function of being connected to a variety of computer networks with a wireless communication function; a function of transmitting and receiving a variety of data with a wireless communication function; and a function of reading a program or data stored in a memory medium and displaying the program or data on a display portion. Further, the electronic device including a plurality of display portions can have a function of displaying image data mainly on one display portion and displaying text data on another display portion, a function of displaying a three-dimensional image by displaying images in consideration of parallax on a plurality of display portions, or the like. Furthermore, the electronic device including an image receiving portion can have a function of photographing a still image, a function of photographing a moving image, a function of automatically or manually correcting a photographed image, a function of storing a photographed image in a memory medium (an external memory medium or a memory medium incorporated in a camera), a function of displaying a photographed image on a display portion, or the like. Note that functions which can be provided for the electronic devices illustrated in FIGS. 21A to 21H and FIGS. 22A to 22D are not limited to those described above, and the electronic devices can have a variety of functions.

Next, application examples of a semiconductor device will be described.

Figure 22E:
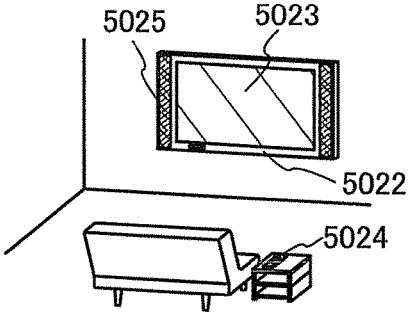

FIG. 22E illustrates an example in which the semiconductor device is incorporated in a building structure. FIG. 22E illustrates a housing 5022, a display portion 5023, a remote controller 5024 which is an operation portion, a speaker 5025, and the like. The semiconductor device is incorporated in the building as a wall-hanging type and can be provided without requiring a large space.

Figure 22F:
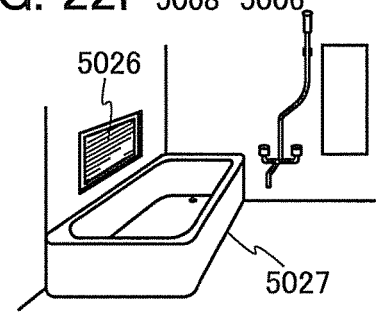

FIG. 22F illustrates another example in which the semiconductor device is incorporated in a building. A display panel 5026 is integrated with a prefabricated bath 5027, so that a person who takes a bath can watch the display panel 5026.

Note that although the wall and the prefabricated bath are given as examples of the building in this embodiment, this embodiment is not limited to these examples and the semiconductor device can be provided in a variety of buildings.

Next, examples in which a semiconductor device is incorporated with a moving object will be described.

Figure 22G:
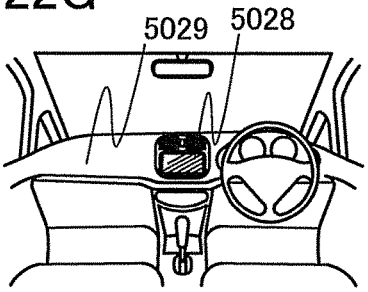

FIG. 22G illustrates an example in which the semiconductor device is provided in a car. A display panel 5028 is provided in a body 5029 of the car and can display information related to the operation of the car or information input from inside or outside of the car on demand. Note that a navigation function may be provided.

Figure 22H:
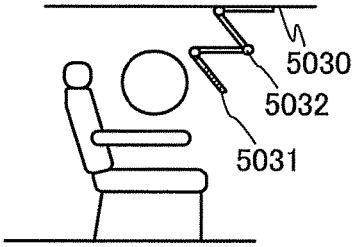

FIG. 22H illustrates an example in which the semiconductor device is incorporated in a passenger airplane. FIG. 22H shows a usage pattern when a display panel 5031 is provided for a ceiling 5030 above a seat of the airplane. The display panel 5031 is integrated with the ceiling 5030 through a hinge portion 5032, and a passenger can watch the display panel 5031 by extending and contracting the hinge portion 5032. The display panel 5031 has a function of displaying information when operated by the passenger.

Note that although the body of the car and the body of the plane are given as examples of the moving body in this embodiment, this embodiment is not limited to these examples. The semiconductor device can be provided for a variety of moving bodies such as a two-wheel motor vehicle, a four-wheel vehicle (including a car, bus, and the like), a train (including a monorail, a railway, and the like), and a ship. This application is based on Japanese Patent Application serial No. 2010-099844 filed with Japan Patent Office on Apr. 23, 2010, the entire contents of which are hereby incorporated by reference.

What is claimed is:

1. A method for driving a display device including an electrode, a counter electrode, and a display element placed between the electrode and the second counter electrode, the method comprising the steps of: in a first period, initializing or setting the display element to a first desired gray level while a first potential is applied to the counter electrode; in a second period following the first period, maintaining application of the first potential to the counter electrode, applying the first potential to the electrode, and switching a potential of the electrode and a potential of the counter electrode from the first potential to a second potential while maintaining application of a substantially zero voltage to the display element during the second period, independently of data to be displayed by the display element; and in a third period following the second period, initializing or setting the display element to a second desired gray level while the second potential is applied to the counter electrode, wherein a timing of switching the potential of the electrode is substantially the same as a timing of switching the potential of the counter electrode, and wherein the first potential and the second potential each have a value equal to or greater than a ground potential.

2. The method for driving a display device, according to claim 1, wherein the display element is a microcapsule electrophoretic element.

3. A method for driving a display device including a plurality of pixels each including an electrode, a counter electrode, and a display element placed between the electrode and the counter electrode, the method comprising the steps of: in a first period, initializing or setting the display elements to first desired gray levels while a first potential is applied to the counter electrodes; in a second period following the first period, selecting the plurality of pixels sequentially, applying the first potential to the electrode and to the counter electrode concurrently for each pixel; in a third period following the second period, selecting concurrently the plurality of pixels and applying concurrently a second potential to the electrode and to the counter electrode for each pixel while maintaining application of a substantially zero voltage to the display elements during the second period and the third period, independently of data to be displayed by the display elements; and in a fourth period following the third period, initializing or setting the display elements to second desired gray levels while the second potential is applied to the counter electrodes, wherein a timing of switching from the first potential to the second potential applied to the electrode is substantially the same as a timing of switching from the first potential to the second potential applied to the counter electrode for each pixel, and wherein the first potential and the second potential each have a value equal to or greater than a ground potential.

4. The method for driving a display device according to claim 3, wherein the third period is longer than the second period.

5. The method for driving a display device, according to claim 3, wherein the display element is a microcapsule electrophoretic element.

6. A method for driving a display device including a wiring, a plurality of electrodes, a counter electrode, and a plurality of display elements each placed between one of the plurality of electrodes and the counter electrode, and a plurality of switching elements each electrically connected between one of the plurality of electrodes and the wiring, the method comprising the steps of: in a first period, initializing or setting the plurality of display elements to first desired gray levels while a first potential is applied to the counter electrode; in a second period following the first period, turning on the plurality of switching elements sequentially, applying the first potential to the wiring and to the counter electrode concurrently; in a third period following the second period, turning on the plurality of switching elements concurrently, applying concurrently a second potential to the wiring and to the counter electrode while maintaining application of a substantially zero voltage between the counter electrode and each electrode of the plurality of electrodes during the second period and the third period, independently of data to be displayed by the display elements; and in a fourth period following the third period, initializing or setting the plurality of display elements to second desired gray levels while the second potential is applied to the counter electrode, wherein a timing of switching from the first potential to the second potential applied to the wiring is substantially the same as a timing of switching from the first potential to the second potential applied to the counter electrode, and wherein the first potential and the second potential each have a value equal to or greater than a ground potential.

7. The method for driving a display device according to claim 6, wherein the third period is longer than the second period.

8. The method for driving a display device, according to claim 6, wherein the plurality of display elements are a plurality of microcapsule electrophoretic elements.

* * * * *